US008930031B2

(12) United States Patent
Wong et al.

(10) Patent No.: US 8,930,031 B2
(45) Date of Patent: Jan. 6, 2015

(54) LAUNDRY MACHINE

(75) Inventors: Richard Wong, Auckland (NZ); Gregory Raymond Collecutt, Ash Grove (AU); David Charles Rhodes, Auckland (NZ); Kane Samuel Alward, Auckland (NZ)

(73) Assignee: Fisher & Paykel Appliances Limited, Auckland (NZ)

( * ) Notice: Subject to any disclaimer, the term of this patent is extended or adjusted under 35 U.S.C. 154(b) by 851 days.

(21) Appl. No.: 13/139,878

(22) PCT Filed: Dec. 17, 2009

(86) PCT No.: PCT/NZ2009/000295

§ 371 (c)(1),
(2), (4) Date: Dec. 19, 2011

(87) PCT Pub. No.: WO2010/071458

PCT Pub. Date: Jun. 24, 2010

(65) Prior Publication Data

US 2012/0089258 A1 Apr. 12, 2012

Related U.S. Application Data

(60) Provisional application No. 61/138,228, filed on Dec. 17, 2008.

(51) Int. Cl.

| | |
|---|---|
| ***D06F 37/22*** | (2006.01) |
| ***D06F 37/20*** | (2006.01) |
| ***D06F 35/00*** | (2006.01) |

(52) U.S. Cl.

CPC ..... *D06F 37/203* (2013.01); *D06F 35/007* (2013.01); *D06F 37/225* (2013.01)

USPC ..... 700/279

(58) Field of Classification Search

None

See application file for complete search history.

(56) References Cited

U.S. PATENT DOCUMENTS

| | | | |
|---|---|---|---|
| 2,534,269 | A | 12/1950 | Kahn et al. |
| 2,610,523 | A | 9/1952 | Kahn |
| 2,647,386 | A | 8/1953 | Keiper |

(Continued)

FOREIGN PATENT DOCUMENTS

| | | |
|---|---|---|
| CA | 990528 | 6/1976 |
| EP | 071308 | 9/1983 |

(Continued)

OTHER PUBLICATIONS

Wagner, F. and Pfeiffer, F., "On the Dynamics of Washing Machines," Journal of Applied Mathematics and Mechanics, vol. 80, issue S2, pp. 307-308, 2000.*

(Continued)

*Primary Examiner* — Kenneth Lo
*Assistant Examiner* — Christopher E Everett
(74) *Attorney, Agent, or Firm* — Clark Hill PLC

(57) ABSTRACT

A laundry machine includes a drum supported at least two spaced apart support locations for rotation about a rotation axis. A balance correction system is able to apply a variable amount of a balance correction mass at a selectable angular location of the drum at least two spaced apart locations along the drum rotation axis. A controller receives outputs of a set of sensors, and is programmed to continuously calculate balance corrections to apply.

19 Claims, 13 Drawing Sheets

(56) References Cited

U.S. PATENT DOCUMENTS

| | | | | |
|---|---|---|---|---|
| 3,117,926 | A | 1/1964 | Starr et al. | |
| 3,214,946 | A | 11/1965 | Starr et al. | |
| 3,235,082 | A | 2/1966 | Compans | |
| 3,983,035 | A | 9/1976 | Arkeveld et al. | |
| 4,292,769 | A | 10/1981 | Maag et al. | |
| 4,400,838 | A | 8/1983 | Steers et al. | |
| 4,513,464 | A | 4/1985 | Rettich et al. | |
| 4,857,814 | A | 8/1989 | Duncan | |
| 4,905,419 | A | 3/1990 | Makarov et al. | |
| 4,991,247 | A | 2/1991 | Castwall et al. | |
| 5,070,565 | A | 12/1991 | Sood et al. | |
| 5,280,660 | A | 1/1994 | Pellerin et al. | |
| 5,345,792 | A | 9/1994 | Farrington et al. | |
| 5,561,993 | A * | 10/1996 | Elgersma et al. | 68/23.2 |
| 5,671,494 | A | 9/1997 | Civanelli et al. | |
| 6,097,115 | A * | 8/2000 | Tevaarwerk et al. | 310/216.016 |
| 6,134,926 | A * | 10/2000 | Vande Haar et al. | 68/12.06 |
| 6,210,099 | B1 | 4/2001 | Hugbart et al. | |
| 6,363,756 | B1 | 4/2002 | Seagar et al. | |
| 6,393,918 | B2 | 5/2002 | French et al. | |
| 6,477,867 | B1 | 11/2002 | Collecutt et al. | |
| 6,532,422 | B1 * | 3/2003 | Elgersma et al. | 702/41 |
| 6,578,225 | B2 | 6/2003 | Jonsson | |
| 6,622,105 | B2 * | 9/2003 | Determan | 702/105 |
| 6,640,372 | B2 | 11/2003 | Ciancimino et al. | |
| 6,715,175 | B2 | 4/2004 | Ciancimino et al. | |
| 6,775,870 | B2 * | 8/2004 | Gayme et al. | 8/159 |
| 6,795,792 | B2 * | 9/2004 | Stalsberg et al. | 702/173 |
| 6,874,006 | B1 * | 3/2005 | Fu et al. | 708/442 |
| 7,000,436 | B2 | 2/2006 | Peterson | |
| 7,059,002 | B2 | 6/2006 | Lee et al. | |
| 7,195,129 | B2 * | 3/2007 | Klemm | 220/62.15 |
| 7,246,397 | B2 | 7/2007 | Kim et al. | |
| 7,530,133 | B2 | 5/2009 | Mitts | |
| 7,581,272 | B2 * | 9/2009 | Xie et al. | 8/159 |
| 8,590,083 | B2 * | 11/2013 | Rhodes | 8/159 |
| 2001/0052265 | A1 | 12/2001 | French et al. | |
| 2005/0016227 | A1 | 1/2005 | Lee | |
| 2005/0112006 | A1 | 5/2005 | Chu | |
| 2005/0155159 | A1 | 7/2005 | Peterson | |
| 2005/0268670 | A1 | 12/2005 | Hirasawa et al. | |
| 2005/0284192 | A1 | 12/2005 | Altinier et al. | |
| 2006/0185095 | A1 | 8/2006 | Mitts | |
| 2007/0050919 | A1 | 3/2007 | Koo | |
| 2007/0101511 | A1 | 5/2007 | Park et al. | |

FOREIGN PATENT DOCUMENTS

| | | |
|---|---|---|
| EP | 0 361 775 | 4/1990 |
| EP | 361775 | 4/1990 |
| EP | 494667 | 7/1992 |
| EP | 507138 | 7/1992 |
| EP | 476423 | 12/1995 |
| EP | 704567 | 3/1996 |
| EP | 732436 | 9/1996 |
| EP | 732437 | 9/1996 |
| EP | 792963 | 3/1997 |
| EP | 0 856 604 | 8/1998 |
| GB | 711531 | 7/1954 |
| GB | 1598399 | 9/1981 |
| JP | 2-043985 | 3/1990 |
| JP | 03-086197 | 4/1991 |
| JP | 04-31901 | 2/1992 |
| JP | 04-297298 | 10/1992 |
| JP | 04-370804 | 12/1992 |
| JP | 06-134205 | 5/1994 |
| JP | 06-246092 | 9/1994 |
| JP | 09-290089 | 11/1997 |
| JP | 10-146491 | 6/1998 |
| JP | 10-174797 | 6/1998 |
| WO | 89/12132 | 12/1989 |
| WO | 99/53130 | 10/1999 |
| WO | 00/28128 | 5/2000 |
| WO | 00/39382 | 7/2000 |
| WO | 03/023116 | 3/2003 |
| WO | WO 2008/075987 | 6/2008 |
| WO | WO 2009/028963 | 3/2009 |

OTHER PUBLICATIONS

Yingqin Yuan; Buendia, A; Martin, R.; Ashrafzadeh, F., "Unbalanced Load Estimation Algorithm Using Multiple Mechanical Measurements for Horizontal Washing Machines," Sensors, 2007 IEEE , pp. 1303-1306, Oct. 28-31, 2007.*

Yingqin Yuan, "Sensor fusion based testing station for unbalanced load estimation in horizontal washing machines," Instrumentation and Measurement Technology Conference Proceedings, 2008. IMTC 2008. IEEE , pp. 1424-1428, May 12-15, 2008.*

Papadopoulos, E.; Papadimitriou, I, "Modeling, design and control of a portable washing machine during the spinning cycle," Advanced Intelligent Mechatronics, 2001. Proceedings. 2001 IEEE/ASME International Conference on , vol. 2, pp. 899-904 vol. 2, 2001.*

Sonoda, Y.; Yamamoto, H.; Yokoi, Y., "Development of the vibration control system "G-Fall Balancer" for a drum type washer/dryer," Advanced Intelligent Mechatronics, 2003. AIM 2003. Proceedings. 2003 IEEE/ASME International Conference on , vol. 2, pp. 1140-1144, Jul. 20-24, 2003.*

Written Opinion of the International Searching Authority completed by the Australian Patent Office on Mar. 22, 2010 (5 pages).

* cited by examiner

LAUNDRY MACHINE

This application is a United States National Phase filing of PCT/NZ2009/000295, having an International filing date of Dec. 17, 2009 which was published in English on Jun. 24, 2010 under International Publication Number WO 2010/071458 which claims the benefit of U.S. provisional patent application Ser. No. 61/138,228, filed on Dec. 17, 2008. These applications are hereby incorporated by reference in their entirety.

BACKGROUND OF THE INVENTION

1. Field of the Invention

This invention relates to a laundry appliance.

2. Description of the Prior Art

Conventional horizontal axis washing machines involve a final spin cycle to extract as much water as possible from the washed articles to reduce the drying time. However, the requirement of a high spin speed is at odds with quiet operation. At the beginning of a spin the cycle the wash load can be quite severely unbalanced, such that when the machine tries to accelerate noise and stressful vibrations result.

The means that washing machine designers have employed so far to cater for imbalance in the load, is typically to suspend the internal assembly on springs and dampers in order to isolate its vibration. The difficulty is these suspension assemblies never isolate the vibration completely, and as the machine ages they deteriorate. Also, these suspension assemblies require significant internal clearance, and so valuable load capacity is lost when designing a machine to standard outside dimensions. Further, because the internal assembly must still withstand the forces due to the imbalance, considerable extra costs result.

Present machines also try to eliminate the problem at its source, for which there are various solutions. The first possibility is to ensure that the wash load is more evenly distributed prior to spinning. This is effective at reducing the imbalance, but does not usually eliminate the imbalance. At high spin speeds, even small imbalances create large vibrations. Therefore while steps can be taken to reduce the degree of imbalance, it is not possible to eliminate it sufficiently to ignore it there after. So these techniques are usually used in conjunction with the suspended tub systems.

Another approach is to determine the size and nature of the imbalance, and add a balance mass that counteracts the imbalance.

Methods of compensating for imbalance in horizontal axis washing machines have been disclosed in U.S. Pat. No. 5,280,660 (Pellerin et al.), European Patent 856604 (Fagor, S. Coop). These disclosures relate to the use of three axially orientated chambers running the length of the drum, placed evenly around the periphery of the drum. These chambers can be individually filled with water in appropriate amounts to approximately correct the imbalance.

The disadvantage to these systems is that the imbalance may not be centered along the axis of rotation, and since no control is available along the axis of rotation this form of balancing will only ever be partially successful. This may mean that a suspension system is still required to isolate the vibration.

Static Imbalance

When an object of some shape or form is spun about a particular axis, the object mass exhibits static and dynamic imbalance. Static imbalance is where the axis of rotation does not pass through the centre of gravity (CoG) of the object. This means that a force must be applied to the object (acting through the CoG) to keep accelerating the object towards the axis of rotation. This force (F) must come from the surrounding structure and the direction of the force rotates with the object, as illustrated in FIG. 1. There are two pieces of information required to define a static imbalance 3. They are the magnitude of the imbalance 1 (the moment of the CoG about the spin axis, which in SI units has dimensions kg m), and some angle 2 between the direction of the offset of the CoG and some reference direction within the object 4.

When mounted to have a horizontal rotation axis, and allowed to rotate under the influence of gravity, an object with a static imbalance will rotate until its CoG lies vertically under its axis of rotation. This also has the consequence that a horizontal axis machine, running at speeds slower than its resonance on its suspension and at constant power input, will exhibit a slight fluctuation in rotation speed as the CoG goes up one side and down the other. Unfortunately this is not a feasible technique for determining static imbalance at anything other than very slow speeds.

Dynamic Imbalance

Dynamic imbalance is more complex. In FIG. 2 the axis of rotation 5 is not parallel with one of the principle axes 6 of the object. The principal axes of an object are the axes about which the object will naturally spin.

For example, a short length of uniform cylinder 7 set to spin about its axis of extrusion is both statically and dynamically balanced. If two weights are attached to the inside of the cylinder, one 8 at one end and the other 9 at the other end but on the opposite side from the first one the CoG 10 of the object has not been moved and so the object is still statically balanced. However now spinning the cylinder will cause vibration as it has a dynamic imbalance. Static imbalance can be detected statically by determining which way up the object rolls over to rest. Dynamic imbalance can only be detected with the object rotating.

Methods for compensating for imbalance, including dynamic imbalance, are disclosed in U.S. Pat. No. 6,477,867 (Collecutt et al) and in U.S. Pat. No. 5,561,993 (Elgersma et al).

U.S. Pat. No. 6,477,867 discloses a balancing system where the output balance mass, in the form of water, is supplied to selected chambers at both ends of the drum to compensate for the calculated out of balance. The output of a force sensor at each end of the drum is processed to calculate an out of balance force as a rotating vector at each end of the drum.

Each end is treated separately. Two techniques are suggested to compensate for non-rigid systems, such as flexing of the machine cabinet or surroundings. An accelerometer may be provided adjacent each force sensor. The output of the accelerometer is included in processing the force sensor output to compensate for the force attributable to movement of the machine in the same measurement axis as the force sensor. Alternatively a method of calculating a system response is presented. The calculated system response is applied to the measured out of balance forces to calculate a balance correction.

While the systems presented in U.S. Pat. No. 6,477,867 are effective up to a certain degree there is a desire for further improvement in balancing accuracy so that the laundry machine drum may be accelerated to still higher speeds.

U.S. Pat. No. 5,561,993 discloses a balancing system where balance mass, in the form of water, is supplied to selected locations at both ends of the drum. The location and magnitude of the mass is calculated using Newton Raphsen iteration from a front force sensor input (vector), a back force sensor input (vector) a front acceleration sensor input (vector) and a back acceleration sensor input (vector). This iterative method involves applying known test masses at known locations. The system response to the test masses informs the calculation of a proposed counterbalance mass expected to reduce the sensor inputs.

The inventors believe that for the increased rotational speeds that are now desired the system response changes rapidly and unpredictably, so that the methods that require application of test masses are largely ineffective once the machine reaches these higher speeds.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

SUMMARY OF THE INVENTION

It is an object of the present invention to provide a balancing system for a laundry appliance which goes someway towards overcoming the above mentioned disadvantages or will at least provide the industry with a useful choice.

According to one aspect the invention consists in a laundry machine comprising:

a drum supported at least two spaced apart support locations for rotation about a rotation axis, sensors collectively providing:

- output from which the force component of the supporting force on parallel axes at the two spaced apart support locations can be derived,
- output from which the acceleration component of acceleration of the two spaced apart support locations on the parallel axes can be derived,
- output from which the angular velocity of said drum rotation axis about an axis through its centre of mass, perpendicular to its rotation axis and parallel to the force component axes can be derived,
- output from which the mass of the rotating drum and/or laundry load, and the axial location (along the rotation axis) of the centre of this mass, can be continuously derived, a balance correction system able to apply a variable amount of a balance correction mass at a selectable angular location of the drum at least two spaced apart locations along the drum rotation axis, and a controller receiving outputs of the sensors, and programmed to continuously calculate balance corrections to apply, the calculation accounting for:

a) the effect of acceleration of the sensor locations on the measured forces, b) the effect conservation of angular momentum has on the measured forces due to angular velocity of the drum rotation axis about an axis through its centre of mass, perpendicular to its spin axis and parallel to the sensed force axis, and c) the effect the axial location of the centre of mass of the rotating drum/load has on the effects in a) and b).

According to a further aspect of the invention the sensors comprise:

first sensors at the two spaced apart support locations, measuring forces such that the force component on parallel axes at the locations can be derived, second sensors at two spaced apart locations, providing output from which the acceleration component on the parallel axes at the locations of the force sensors can be derived, a third sensor or sensors, providing output from which the angular velocity of the drum rotation axis about an axis through its centre of mass, perpendicular to its spin axis and parallel to the force sensor axis can be derived, fourth sensor or sensors providing output from which the mass of the rotating drum and/or laundry load, and the axial location (along the spin axis) of the centre of this mass, can be derived, the sensors not necessarily being individual relative to each other.

According to a further aspect of the invention the calculation estimates the forces induced due to movement of the support locations in line with the force measurement.

According to a further aspect of the invention the calculation estimates the forces induced due to movement of the support locations in a plane transverse to the axis of force measurement.

According to a further aspect of the invention the calculation estimates the induced force as the product of a mass and inertia term and an acceleration term.

According to a further aspect of the invention the mass and inertia term accounts for the effect at each end of movement applied at that end and movement applied at the other end based on reaction around the estimated centre of mass of the spinning drum and load.

According to a further aspect of the invention the acceleration term accounts for the movement on the force axis and movement transverse to the force axis.

According to a further aspect of the invention the acceleration term accounts for movement transverse to the force axis by allocating a proportion of the total angular acceleration to each support location based on the estimated location of the centre of mass between the ends.

According to a further aspect of the invention the machine includes a support frame for the drum, and first and second bearings supporting the drum to rotate about a horizontal axis, wherein the bearings are rigidly, or substantially rigidly, supported in the support frame.

According to a further aspect of the invention the sensors include a first horizontal accelerometer sensing horizontal acceleration of the first bearing and a second horizontal accelerometer sensing horizontal acceleration of the second bearing.

According to a further aspect of the invention the machine includes balancing chambers distributed around each of two ends of the drum and water supply paths to transmit water to selected balancing chambers.

According to a further aspect of the invention the controller selectively supplies water to the balance chambers in each spin cycle, after calculating the required balance requirements, where the algorithm uses a physical model of the machine dynamics and calculates an absolute balance requirement accounting for accelerations that are being created (or resisted) in the vertical direction at each support location due to rotation (typically oscillation) of the rotating drum in the horizontal plane.

According to a further aspect of the invention the controller estimates this oscillation from the horizontal accelerations at the support locations.

According to a further aspect of the invention the controller converts the oscillation to nominal vertical acceleration and applies this nominal acceleration effect as a correction to measured vertical acceleration.

According to a further aspect of the invention the controller uses the corrected vertical accelerations to correct the measured forces.

According to a further aspect of the invention the controller corrects measured forces for the accelerations using a mass term that adjusts for the contribution of an acceleration applied at one support location to the support force at the other support location.

According to a further aspect of the invention the drum is supported at locations on a single support shaft and the calculation accounts for flexing of the support shaft and drum.

According to a further aspect of the invention the calculation estimates the force induced by additional centrifugal forces from angular displacement of the drum axis away from the rotation axis due to shaft flexing.

According to a further aspect of the invention the calculation uses a stored value for the stiffness of the supporting shaft and drum.

According to one aspect the invention consists in a laundry machine comprising:

a drum supported at least two spaced apart support locations on a single support shaft for rotation about a rotation axis, sensors collectively providing:

- output from which the force component of the supporting force on parallel axes at the two spaced apart support locations can be derived,
- output from which the acceleration component of acceleration of the two spaced apart support locations on the parallel axes can be derived,
- output from which the angular velocity of said drum rotation axis about an axis through its centre of mass, perpendicular to its rotation axis and parallel to the force component axes can be derived,
- output from which the mass of the rotating drum and/or laundry load, and the axial location (along the rotation axis) of the centre of this mass, can be continuously derived, a balance correction system able to apply a variable amount of a balance correction mass at a selectable angular location of the drum at least two spaced apart locations along the drum rotation axis, and a controller receiving outputs of the sensors, and programmed to continuously calculate balance corrections to apply, the calculation accounting for flexing of the single support shaft.

According to a further aspect of the invention the calculation estimates the force induced by additional centrifugal forces from angular displacement of the drum axis away from the rotation axis due to shaft flexing.

According to a further aspect of the invention the calculation uses a stored value for the stiffness of the supporting shaft and drum.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The term "comprising" is used in the specification and claims, means "consisting at least in part of". When interpreting a statement in this specification and claims that includes "comprising", features other than that or those prefaced by the term may also be present. Related terms such as "comprise" and "comprises" are to be interpreted in the same manner.

BRIEF DESCRIPTION OF THE DRAWINGS

Preferred forms of the present invention will now be described with reference to the accompanying drawings.

BEST MODE FOR CARRYING OUT THE INVENTION

The present invention provides a method and system for balancing the load in a laundry appliance, particularly suited to washing machines. Such a system dispenses with the need for a suspended tub that can move about freely within the confines of the machine. This significantly simplifies the machine design. The following description is with reference to a horizontal axis machine. However the present invention could be applied to off horizontal and vertical machines, as well as rotating laundry appliances in general.

General Appliance Construction

The present invention will be described primarily with reference to a laundry washing machine that executes a centrifugal dehydration action although the principles could also be applied to any laundry machines intended to have a drum rotating at high speed. In a laundry operation the balancing system will operate in each spin extraction phase rather than in a tumbling or washing phase. However the system could operate in any phase where the drum spins sufficiently fast for the laundry load to be held against the surface of the drum through full rotations of the drum. For example the system could operate during a moderate speed spray rinse procedure, or during a moderate speed spray wash procedure where concentrated detergent solution is drawn through the laundry load.

Figure 1:
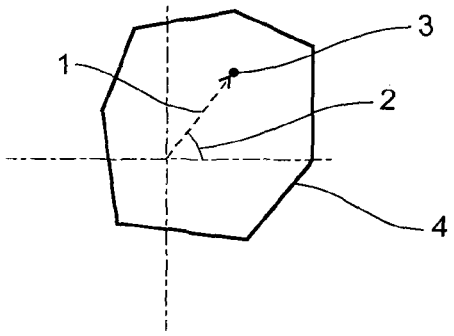
FIG. 1 is an illustration of the concept of static imbalance.
Figure 2:
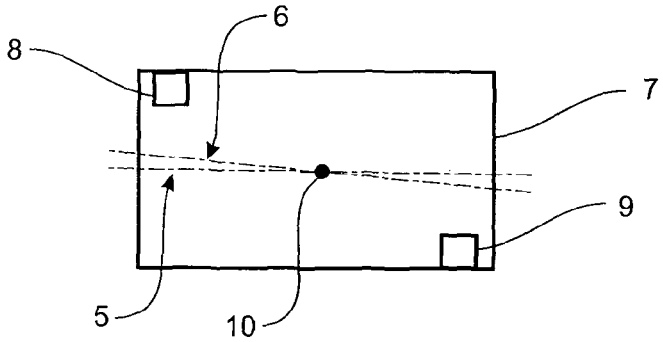
FIG. 2 is an illustration of the concept of dynamic imbalance.
Figure 3:
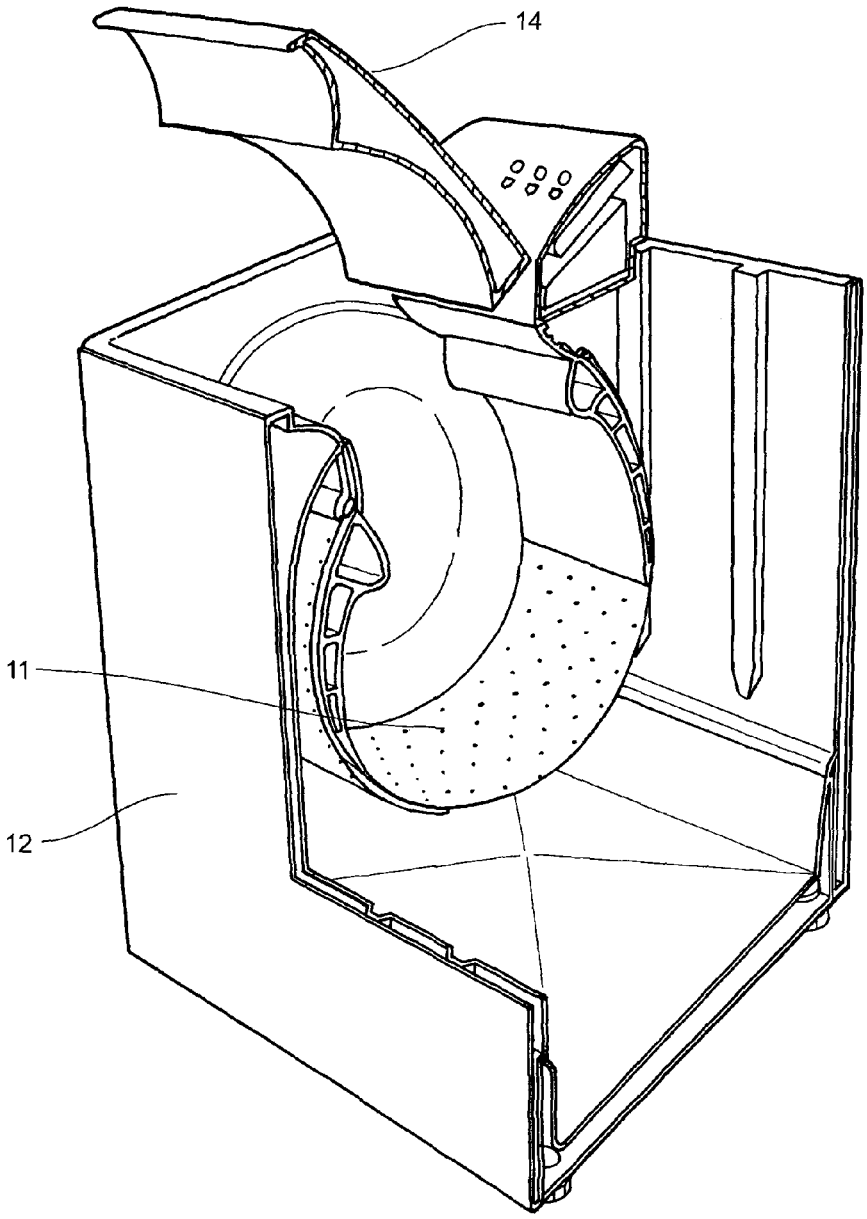
FIG. 3 is a cutaway perspective view of a washing machine of a type that can incorporate the present invention with the cutaway to show the machine substantially in cross section.
Figure 4:
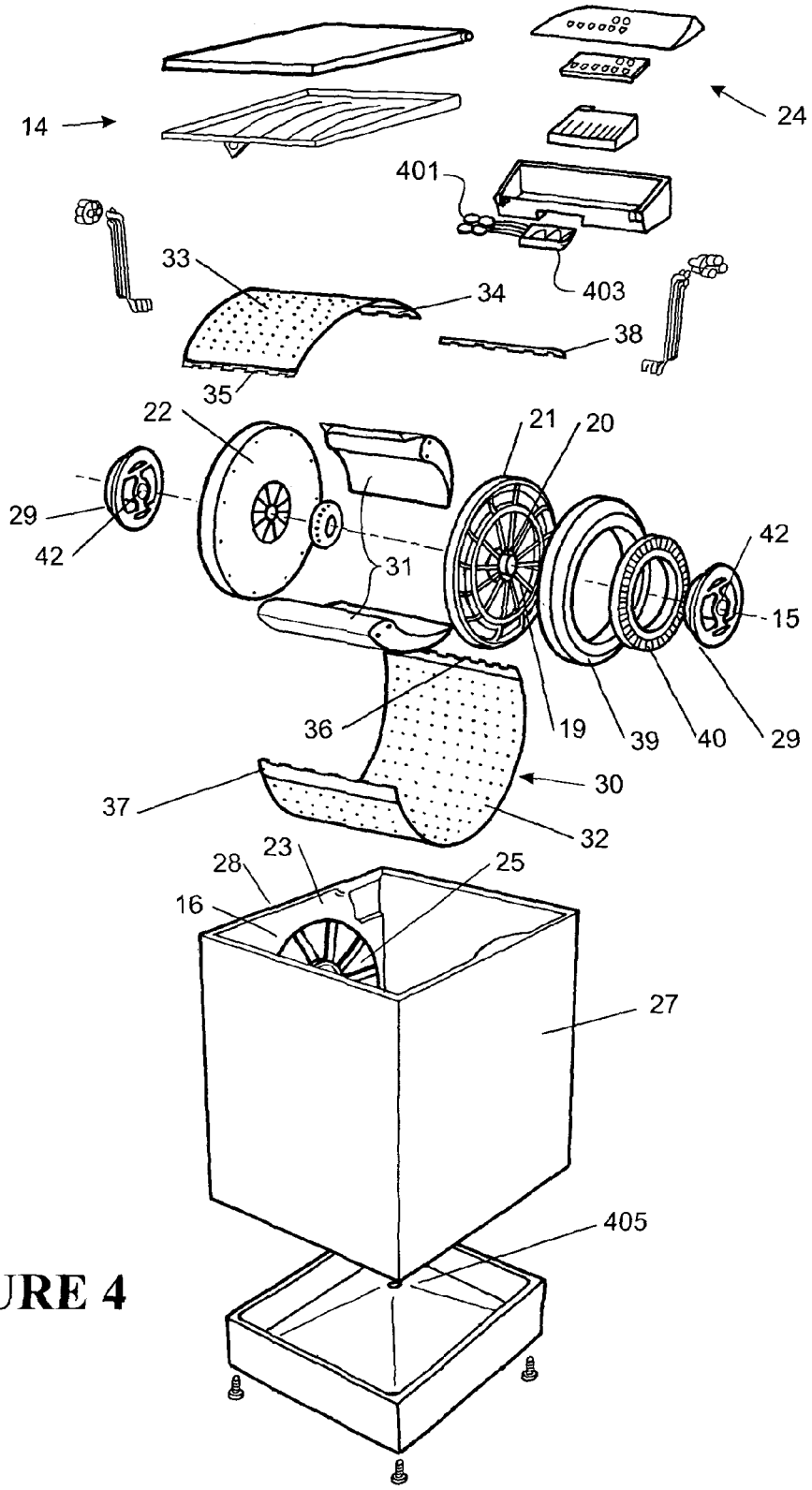
FIG. 4 is an assembly drawing in perspective view of the washing machine of FIG. 3 showing the various major parts that go together to form the machine.

FIGS. 3 and 4 show a washing machine of the horizontal axis type, having a perforated drum 11 supported with its axis substantially horizontal. In the illustrated arrangement the drum is arranged in a side-to-side orientation within a cabinet 12 and accessed through the side wall of the drum.

Figure 16:
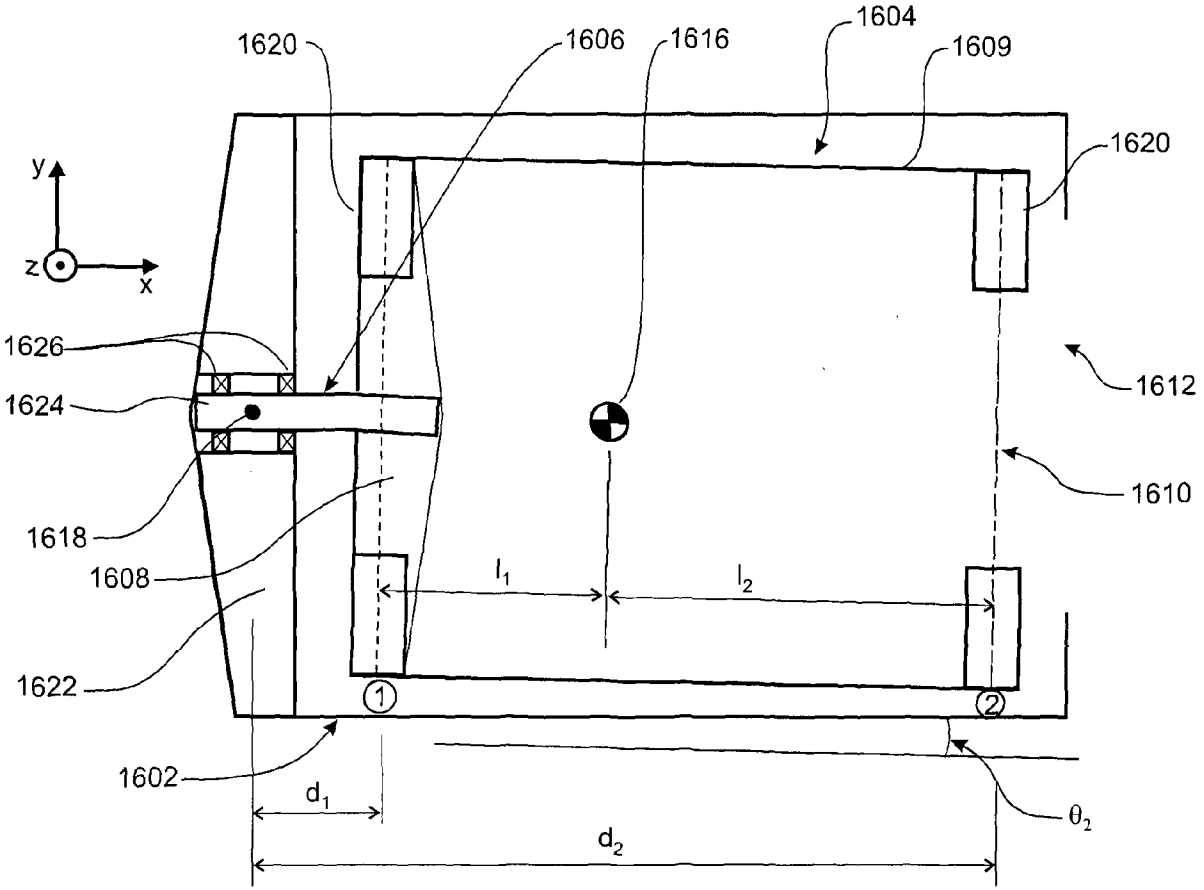
FIG. 16 is a schematic drawing illustrating the terms of a further improved imbalance determination system according to an embodiment of the present invention implemented in a front-loading laundry machine.

An alternative arrangement is illustrated in FIG. 16, where the drum is supported from one end, by a shaft and associated bearings. This is an arrangement suitable for typical front loading laundry machines.

Referring in more detail to the embodiment of FIGS. 3 and 4, the cabinet 12 includes surfaces which confine wash or rinse liquid leaving the drum within a water tight enclosure. Some parts of the cabinet structure 12 may be formed together with the liquid confining surfaces by for example twin-sheet thermoforming. Alternatively the drum may be enclosed in a container separate from the cabinet structure. The container can be mounted essentially rigidly with respect to the cabinet structure.

The cabinet may be a closed structure suitable for a stand alone environment or an open framework that can be installed in a cavity in kitchen or laundry cabinetry.

The laundry handling system including the drum and other components may be arranged in a top loading configuration. In FIG. 3 the horizontally supported drum 11 is contained within a substantially rectangular cabinet 12 with access being provided via a hinged lid 14 on the top of the machine. Other top loading horizontal axis configurations are described in our U.S. Pat. No. 6,363,756, the contents of which is hereby incorporated by reference. Other horizontal axis configurations may be adopted, such as front loading embodiments. In this later case the drum will typically be supported in a cantilever fashion by bearings located at two places on a shaft extending from one end.

In the illustrated arrangement of FIGS. 3 and 4 the drum 11 is rotatably supported by bearings 15 at either end which in turn are each supported by a drum support 16. In the embodiment depicted the bearings are located, externally, on a shaft 19 protruding from the hub area 20 of the drum ends 21, 22.

Other axial configurations are equally possible for example the bearings may be internally located in a well in the outer face of the hub area of the drum to be located on a shaft protruding from the drum support.

The drum supports 16 are shown each as a base supported unit. The drum supports may have integrated form, which again is ideally suited to manufacture by twin sheet thermoforming, injection moulding, blow moulding or the like, or may be fabricated, for example by pressing or folding from steel sheet. Each drum support preferably includes a strengthening rib area 23 and a drum accommodating well area 25 as depicted to accommodate the respective drum end 21, 22 of the drum 1.

The illustrated drum supports 16 engage with a sub-structure by interlocking within complementary surfaces provided in side walls 27, 28. Other constructions are possible, such as frameworks formed from individual members or the drum support could comprise a wash enclosure substantially enclosing the drum and which is in turn supported in said cabinet. The wash enclosure may include bearing mounts at either end. The wash enclosure can be solidly supported on a base of the cabinet with no need for suspension, and no need to accommodate movement between the tub and the cabinet adjacent the user access opening.

The illustrated drum supports 16 each include a bearing support well at the centre of the well area 25. A bearing mount 29 is located within the bearing support well, and in turn the bearing 15 fits within a boss in the bearing mount 29.

These structural details are only one illustrative embodiment and do not constitute part of the present invention. For example, the bearings or shafts may be mounted to the wall of a container that substantially surrounds the drum.

In the illustrated embodiment of the laundry machine, as shown in more detail in FIGS. 3 and 4, the drum 11 comprises a perforated metal hoop 30, a pair of ends 21, 22 enclosing the ends of the hoop 30 to form a substantially cylindrical chamber and a pair of vanes 31 extending between the drum ends 21, 22.

In the illustrated embodiment of the laundry machine the drum is driven only from one end 21 and consequently one function of the vanes 31 is to transmit rotational torque to the non-driven drum end 22. The vanes also provide longitudinal rigidity to the drum assembly 11. To these ends the vanes 30 are wide and shallow, although they have sufficient depth and internal reinforcing to provide resistance to buckling due to unbalanced dynamic loads. The vanes 30 have a distinct form, including a leading and trailing edge to assist in tumbling the washing load. The vanes 30 are oriented oppositely in a rotational direction, so that under rotation in either direction one vane is going forwards and the other backwards.

This drum structure is only illustrative and does not constitute part of the present invention. For example the drum may be constructed from multiple lengths of perforated steel secured to a framework including a part of drum ends and a number of traverse ribs spanning between the ends.

In the illustrated embodiment of the washing machine incorporating the invention, access to the interior of the drum 11 is provided through a sliding hatch section 33 in the cylindrical wall 30 of the drum. The hatch section is connected through a latching mechanism 34, 35, 36, 37, 38 such that remains closed during operation. The cabinet 12 of the washing machine is formed to provide access to the drum 11 in a substantially top loading fashion, rather than the traditional front loading fashion more common to horizontal axis machines, where access is provided through one end of the drum.

This arrangement is only illustrative. The present balancing system was also used with other opening configurations, such as a front loading configuration of the type illustrated in FIG. 16, or as outlined in our U.S. Pat. No. 6,363,756.

The general configuration of a wash control system will be described with reference to FIGS. 4 and 7.

The washing machine includes an electric motor 701 (rotor 39 and stator 40 visible in FIG. 4) to effect rotation of the drum during all phases of operation (wash, rinse and spin dry). In the preferred embodiment of the washing machine the motor is a direct drive inside-out electronically commutated brushless dc motor. The motor has a permanent magnet rotor 39 coupled to one end 21 of the drum 11 and a stator 40 coupled to the drum support 16. The rotor may secure directly to the drum or may alternatively be secured to one of the supporting shafts. These options are also available in the case of a front loading machine incorporating the present invention. A suitable motor is described in EP0361775 and in many other patents dealing with motor drive systems for laundry machines.

A water supply system applies wash water to the laundry load. The water supply system may be of conventional type, adding water to a sump to reach a level at which the lower portion of the rotating drum is immersed in the wash liquid. The system may include valves 401 supplying water to the sump through selected chambers of a flow through dispenser 403. Alternatively, or in addition, wash liquid may be circulated by a water pump 702 from a sump 405 to be applied directly onto the clothes load in the drum. For example by spraying from nozzles in the drum ends. In the illustrated embodiment this would require a liquid supply path to the rotating drum, for example through a hollow supporting shaft. In a front loading embodiment a spray nozzle could be mounted to the stationary structure that encloses the open front.

The water supply system could include a water supply spigot for receiving a water supply at the machine, a flow control valve capable of at least on and off operation and necessary supply conduits within the machine. The laundry machine may be adapted for warm or hot wash operations, in which case a hot water receiving spigot and valve may be included, or a heater 705 may be included, for example in the pump, to heat water in the sump or circulating in the machine.

A drain pump 703 is provided below the wash sump to receive water from the wash sump and pump the collected water to a drain pipe. The drain pump 703 may double as a wash pump for water recirculation, if included.

A motor controller receives inputs from a position sensor 52. The position sensor may be arranged adjacent the motor, for example a Hall sensor board sensing passing permanent magnet poles or a suitable encoder. Alternatively, the position sensor may operate using back EMF or current sensing or both in relation to the motor windings. The position sensor may comprise software of the controller analysing feedback from the motor.

The motor controller generates motor drive signals to activate commutation switches 719 to selectively apply current to windings of the motor. The motor controller responds to instruction from a main control to increase or decrease the motor torque. The main control may be software executed on the same controller or may be executed on a distant controller. The motor controller may control motor torque by increasing or decreasing the effective drive current or altering the phase angle of the applied current relative to the rotor position or both.

A user interface 24 is provided, allowing user control over the functions and operation of the machine. The control microprocessor 51 is provided within an interface module, and provides electronic control over the operation of the machine, including operation of the motor 701, the water supply valves 54, the recirculation and/or drain pumps 702, 703 and any water heating element 705.

The controls described may be implemented as software executed on one or more micro computer based controllers, or as logic circuits loaded into programmable logic hardware, or as hard wired logic or electronic circuits or combinations of any of these, or other equivalent technologies.

Balancing System

In the present invention the forces caused by an out-of-balance load during high speed rotation of drum 11, for example during, spin drying, are minimised by a dynamically controlled balancing system.

A collection of sensors provide outputs to a controller 51. The controller processes the sensor outputs to calculate imbalance data which in turn is used to take balance correction measures.

In one embodiment each bearing mount is configured to include a vertically acting force sensor that senses the vertical support load on the bearing. The mount also preferably includes an acceleration sensor sensing vertical acceleration of the bearing mount. The mount also includes a sensor sensing horizontal velocity of the bearing mount in a direction transverse to the axis of rotation. In the preferred form the horizontal velocity sensor is an acceleration sensor. The sensor package can be integrated or include multiple discrete sensors. For example, sensor packages are available that provide sensor output for acceleration on two or three axes.

According to the arrangement in FIGS. 3 and 4, the forces, accelerations and velocities may be measured at the axial location of the balance correction chambers. However the forces, velocities and accelerations can be measured at other locations along the axis. In that case the accelerations, forces and velocities can be translated to equivalent forces at the chambers, or the results of the imbalance calculations or the results of an intermediate step can be translated. An example of this transformation is given in U.S. Pat. No. 5,561,993.

Balance Correction Measures

Figure 6:
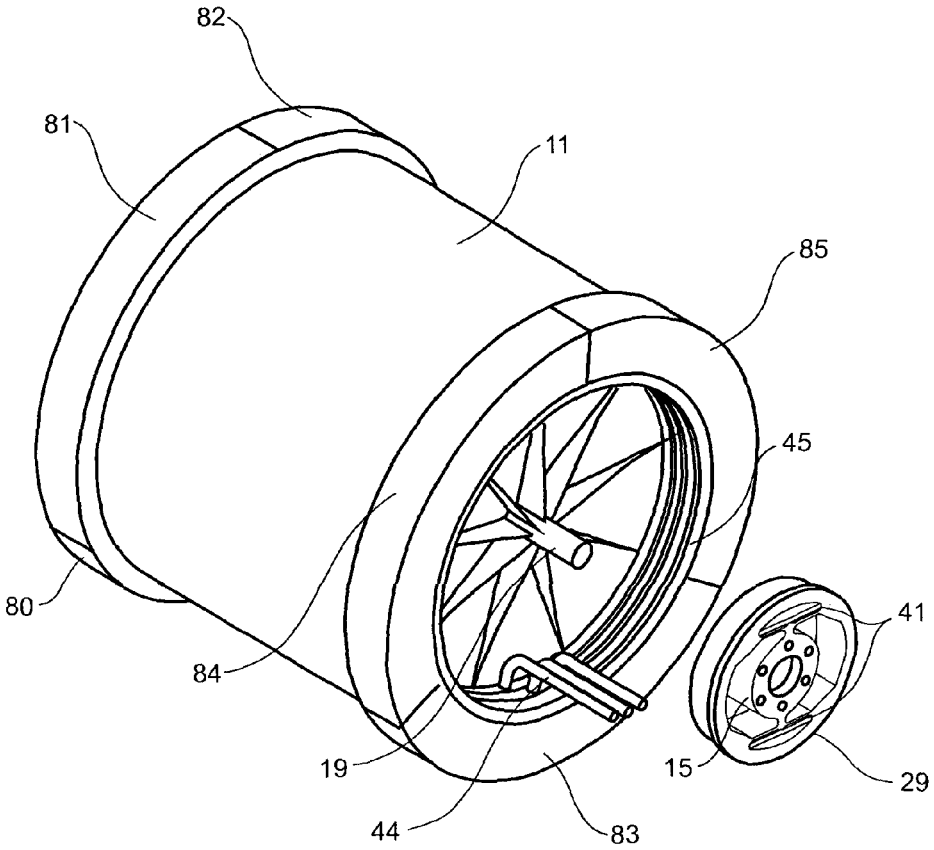
FIG. 6 is an illustration of the drum of the machine of FIG. 3, showing the balancing chambers and sensors.

In the preferred implementation, addition of counterbalance mass is by the addition of water to one or more of the six balancing chambers 80 to 85 located in the drum, as shown in FIG. 6. There are three such chambers at each end spaced 120° apart and positioned on the extremity of the drum end 21, 22.

Figure 7:
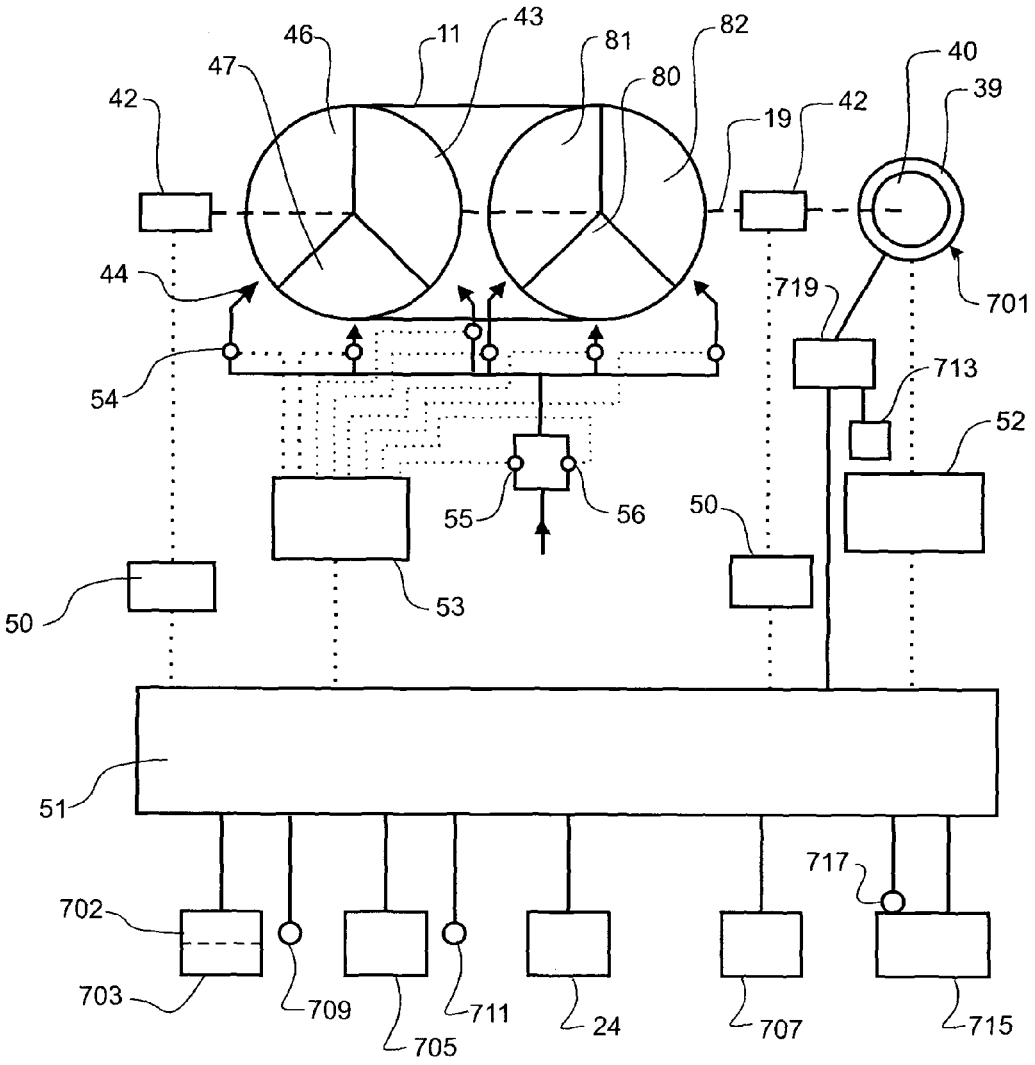
FIG. 7 is a diagrammatic representation of the liquid supply and electrical systems of a washing machine.

In more detail the balancing system is illustrated in FIG. 7. The output from the load cells and accelerometers is first passed through filtering 50 before connection to the inputs of a microprocessor 51, which may be task specific or may be the main control processor for the laundry machine. The various algorithms (detailed later) programmed into the microprocessor 51, will dictate spin commands (eg: speed up/slow down) to the motor speed control and balancing corrections (eg: open/close valve 54) to the valve driver 53. The motor controller in turn, will control the power supply switches 719 to vary energisation of the motor windings to follow the spin command. The valve driver 53 will open or close the appropriate balancing valve 54, which allows water to flow through the injector 44 into the relevant slot 45, whereupon it is channelled to the appropriate chamber. Preferably the valve driver 53 also controls the water flow rate. For example, the valve driver may choose high or low flow valve rates, or control a pressure regulator. An example of a pressure control regulator for this purpose is provided in our copending patent application PCT/NZ2008/000216, which is hereby incorporated by reference in its entirety.

Balance Correction Processing

To correct an imbalance, it is necessary to artificially add equal and opposite static and dynamic imbalances. To add a static imbalance only requires to add a certain amount of mass at some radius and rotation angle (or 'phase' angle), having effectively the same location along the spin axis as the CoG. However, to add a dynamic imbalance requires to effectively add equal and opposite compensation at two locations along the spin axis that are evenly spaced either side of the CoG. The end result is that both static and dynamic imbalances can be corrected by adding, at two separate locations along the spin axis, two independent masses (both may be at the same radius) at two independent phase angles.

Imbalance data is obtained by measuring either acceleration, velocity, force, or displacement at two independent locations on the vibrating system. These measurements are processed to calculate a vector for each end representing the out of balance force nominally acting at each counterbalance axial location. This vector is not raw signal data from the force sensors, but has been compensated for forces that result from movement of the bearing mounts.

As the nominal out of balance force (magnitude and phase angle) at each of the two locations is calculated, another process controls addition of correction mass to correct the imbalance.

Sensors

The balancing system uses electrical signals generated by load cells in the bearing mounts and by associated accelerometers to control the application of counterbalance mass.

In the top loading embodiment a pair of load cells 41 are located with one for each shaft 19 as shown in FIG. 4.

Figure 5:
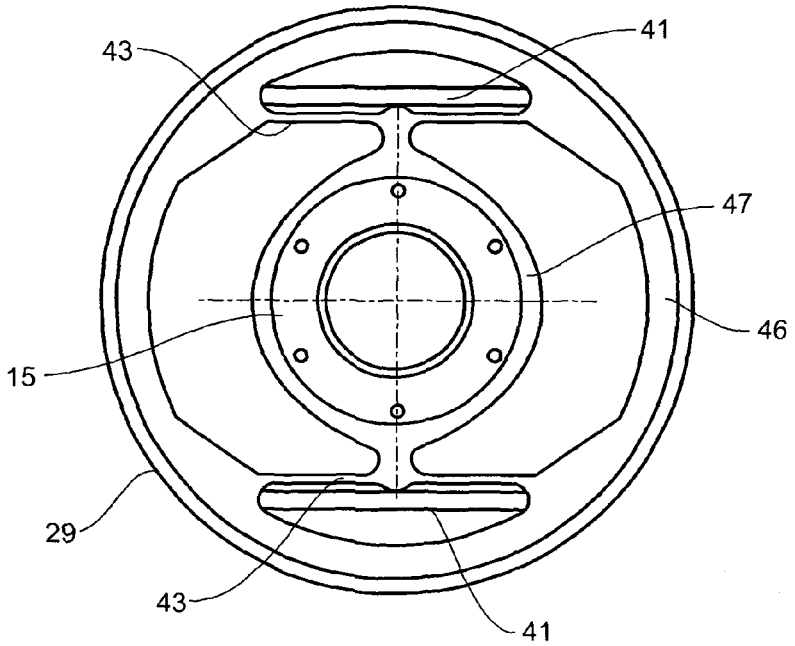
FIG. 5 is an illustration of a drum bearing mount carrying force and acceleration sensors.

The load cell may measure small displacements in a very stiff elastically deforming support system. A strain sensor suited to this application is the piezo disc. This type of sensor produces a large signal output and so is not significantly affected by RFI. FIG. 5 shows an example of a possible bearing mount. This bearing mount includes two concentric cylindrical rings 46, 47. A pair of load bridges 43 are connected at the top and bottom of the inner ring 47, respectively, and to opposite parts of the inner periphery of the outer ring 46. A piezo disc 41 is adhered to the load bridge on the side facing the outer ring. The load from the drum is taken through a bearing 15 mounted in the internal ring 47, through the load bridges 43 and load cell 41 into the outer ring 46, and out into the external structure. The load bridges will flex according to any vertical forces from the spinning of the drum. This deforms the piezo disc and provides a signal representative of the imbalance force.

The load bridges are intended to flex elastically and predictably under applied vertical forces, but only through small actual displacements. For example, vertical displacement of the bearing relative to the fixed structure should be less than 10 mm. The piezo disc will have a particular response in relation to applied force. The out of balance force is proportional to the square of the drum speed and the response magnitude of the sensor is typically proportional to force. The relationship between sensor output and the speed of the drum is cubic. However the support geometry may present a non-linear relation between force and displacement. Either way the controller may be programmed to convert the sensor output to a force measure according to a formula that accounts for speed of rotation.

Control Algorithms

In the exemplary embodiment the task of spinning while balancing is subdivided into three sub-tasks or algorithms:

Imbalance Detection Algorithm (IDA)

Balance Correction Algorithm (BCA)

Spin Algorithm (SA)

Figure 11:
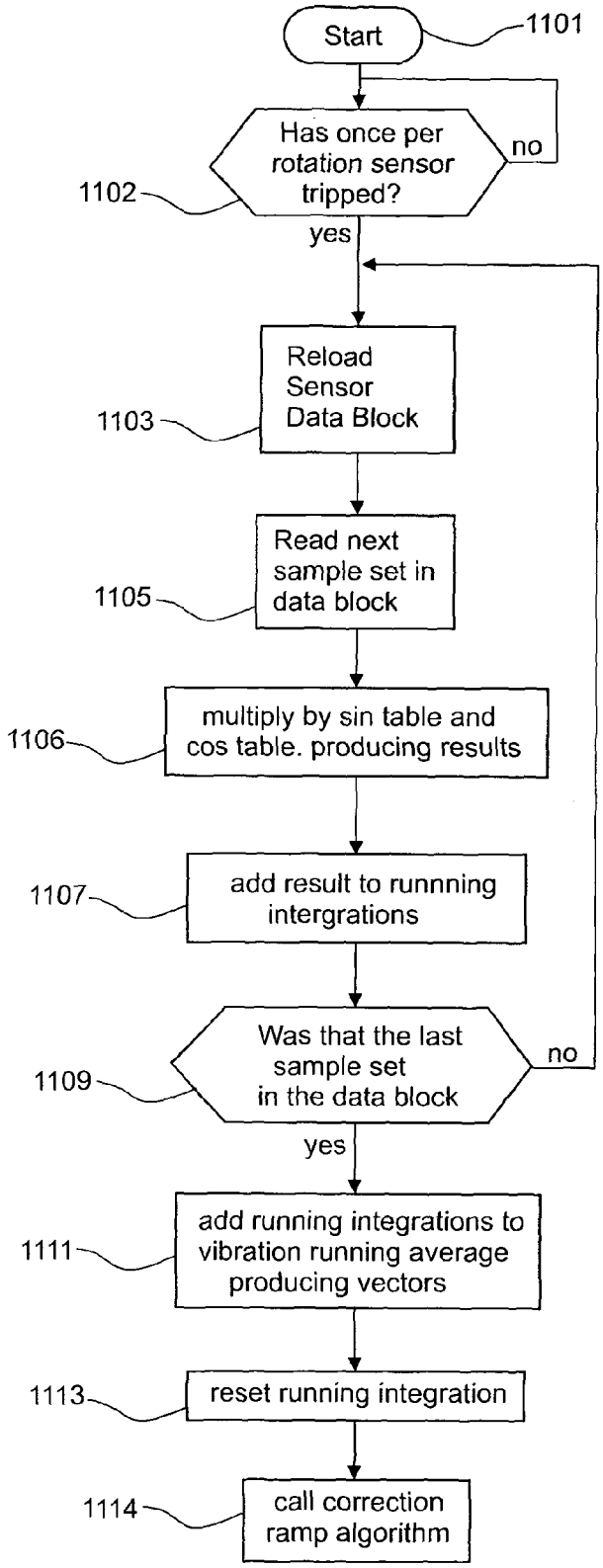
FIG. 11 is a flow diagram illustrating an Imbalance Detection Algorithm.

The Imbalance Detection Algorithm (IDA) (shown in FIG. 11) is concerned solely with the acquisition of imbalance related data, and is embedded in the motor control routine. This function is active whenever the motor is turning, and calculates imbalance vector data. An example algorithm is illustrated in FIG. 11.

Figure 13:
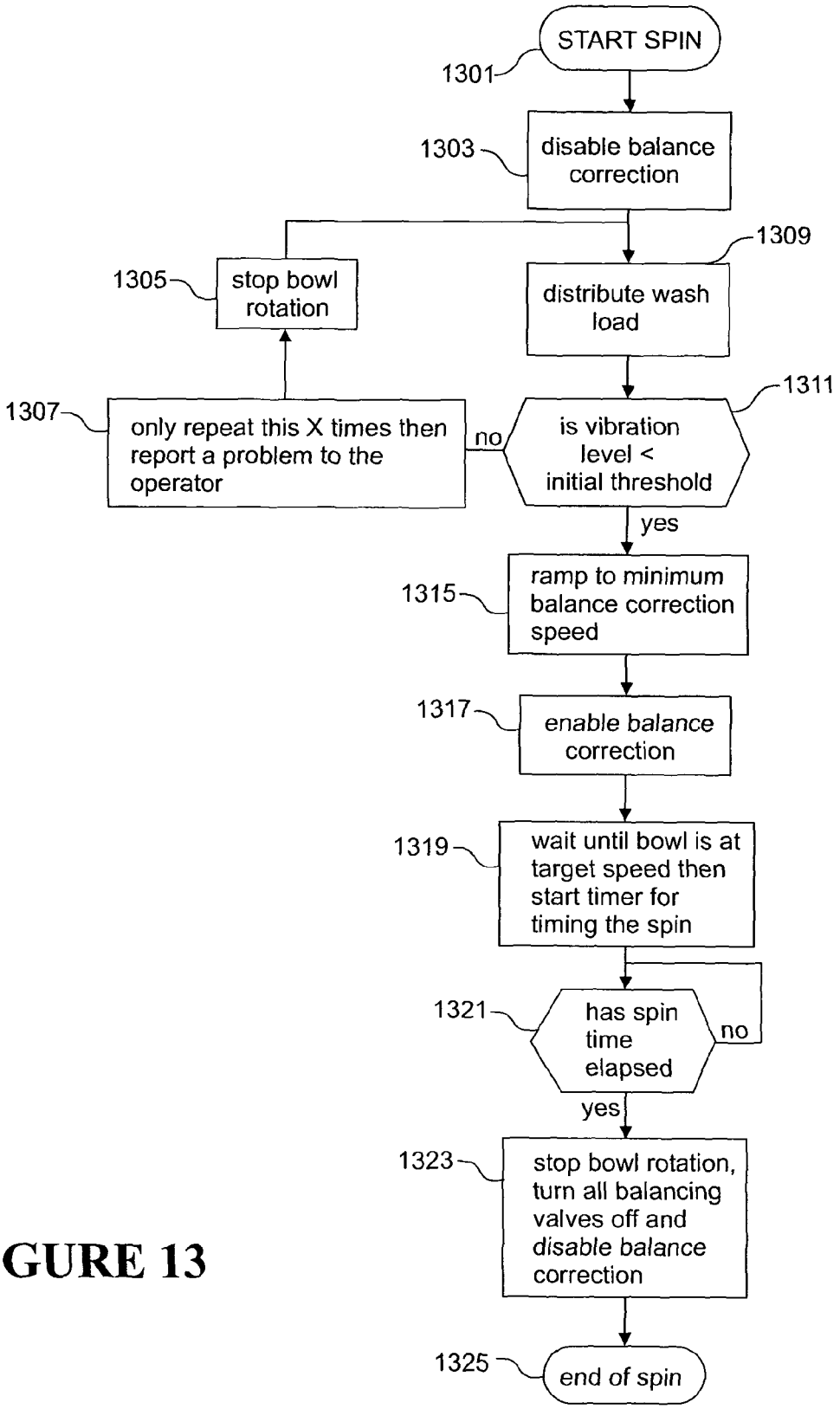
FIG. 13 is a flow diagram illustrating a Spin Algorithm.

The Spin Algorithm (SA) is concerned with executing the spin profile asked of it. The spin algorithm ramps the speed of the machine according to the profile requested and the vibration level determined by the IDA. An example algorithm is illustrated in FIG. 13.

Figure 12:
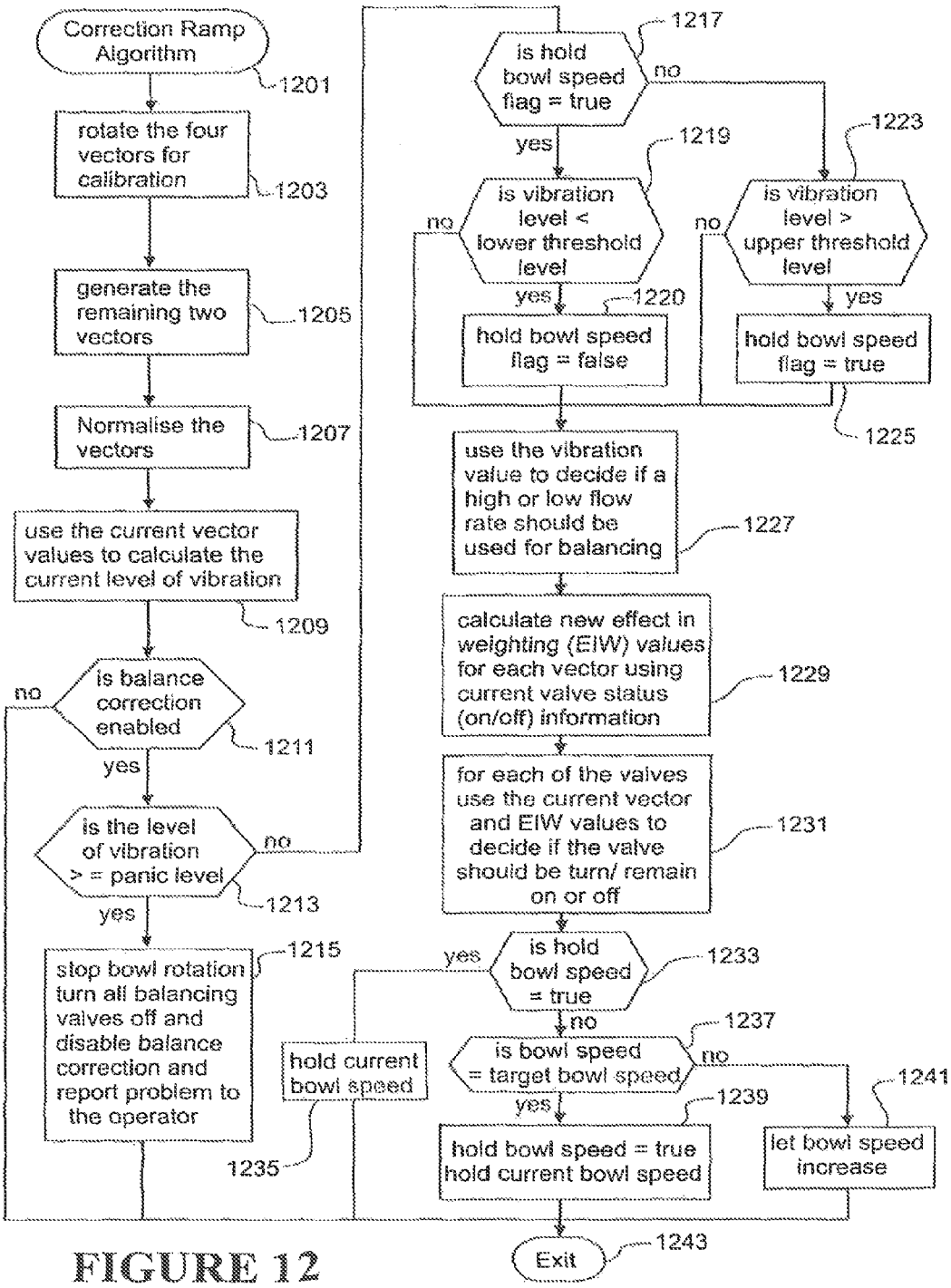
FIG. 12 is a flow diagram illustrating a Balance Correction Algorithm.

The Balance Control Algorithm (BCA) is active at times determined by the spin algorithm and is concerned with correcting whatever imbalance the IDA has determined. The BCA takes into account the time dependent behaviour of both the machine and the IDA. The BCA is active whenever the rotation speed of the machine is sufficient that the load is distributed on the walls of the drum and is believed to be reasonably evenly distributed. For example the BCA may be active when the imbalance is below a threshold value and the rotation speed is greater than 150 rpm. An example algorithm is illustrated in FIG. 12.

Overall Control Strategy—SA

In the exemplary embodiment overall control of the spin process is assigned to the spin algorithm SA. It begins with the bowl speed at zero, and disables the BCA. The first task of the SA is to better distribute the wash load to allow spinning to begin. The spin algorithm brings the drum through a tumbling speed to a low spin speed. If the vibration at this low spin speed is below the initial threshold, the drum is allowed to spin to the minimum BCA speed at which point BCA is enabled. If the vibration is not below the threshold, redistribution is retried a number of times before stopping and displaying an error message. Redistribution involves slowing the drum to a tumbling speed and then reaccelerating to the low spin speed. Once BCA has attained the target level of spin speed the spin is allowed to continue for the desired period after which the bowl is stopped, valves are closed and BCA is disabled.

An exemplary spin algorithm is illustrated in FIG. 13. This method starts at step 1301. The method is executed once, and lasts for the complete spin cycle. The method includes initial steps 1303 to 1315 which seek to ensure a reasonable load balance is achieved before enabling the balance correction and starting the higher speed dehydration. This reduces water consumption by ensuring that water is only used for balance correction when there is a good chance of successfully reaching a full spin speed.

The method includes later steps 1317 to 1325 that enable correction, control the duration of the spin cycle and subsequently end the spin cycle.

The method starts at step 1301 and proceeds to step 1303. At step 1303 the method disables balance correction. While the balance correction is set to disabled the BCA illustrated in FIG. 12 (which is looping on a continuing basis) will exit at step 1211 without taking any balancing actions. The method then proceeds to step 1309.

At step 1309 the method accelerates the drum through a laundry tumbling speed to a speed at which the laundry load will be centrifugally held to the inner surface. This speed will depend on the drum diameter. For example a speed of 100 RPM is sufficient for typical laundry machine drums. The method may do this at any random time or may attempt to predict a better than average moment to accelerate. A method for predicting a better than average moment is suggested in our copending application PCT/NZ2007/000392 which is hereby incorporated by reference in its entirety.

After accelerating to a distributed speed at step 1309 the method proceeds to step 1311. At step 1311 the method compares the vibration level value (being updated repeatedly by step 1209 of the BCA) against an initial threshold. This threshold is preferably preset to a level that is expected to correspond with the largest correctable imbalance. This is largely governed by the magnitude of the balance chambers and the detailed performance of the BCA in choosing balancing actions to take and when to take them. Poor balance correction algorithms use more water than better algorithms to correct the same imbalance. If the vibration is below the threshold the method proceeds directly to step 1315. Otherwise the method loops back to step 1309, by steps 1307 and 1305.

Step 1307 checks whether the test at step 1311 has been failed a predetermined number of times in this spin cycle. For example the method may increment a counter at step 1307 and check this counter each time through the loop. If so then the method reports an error to the main controller, which may in turn issue a user alert. This result would indicate that an abnormal load is incapable of distributing evenly in the bowl. At step 1305 the method reduces the drum speed to a tumbling speed, for example below 60 RPM for a typical drum around 500 mm diameter. The loop then returns to step 1309 to try again.

Once step 1311 determines a good enough distribution has occurred the method proceeds to step 1315. At step 1315 the method instructs the motor control to accelerate the drum up to a minimum drum correction speed. This is a speed that should not cause the imbalance known at step 1311 to create greater than an acceptable vibration of the machine. The method then proceeds to step 1317 and enables balance correction. This will cause the BCA of FIG. 12 to commence balance correction functions, and to increase the drum speed as the balance condition allows until the drum speed reaches a target speed. Meanwhile the method of FIG. 13 waits at step 1319 until the drum reaches the target speed. The method then starts a time for timing the high speed spin phase of the spin cycle.

The method proceeds to step 1321 and waits for the spin time to elapse. The method then moves to step 1323 and ends the spin cycle by stopping bowl rotation, turning off the balancing valves and setting the balance correction flag to disabled.

Dynamic Control and the BCA

In the exemplary embodiment a dynamic control method is used. This is not to be confused with static and dynamic imbalance as explained earlier. Dynamic control refers to the nature of the control methodology. The alternative control methodology is 'static'. A static control method does not make use of or retain data on the time dependent behaviour of its target system. As a result the method is executed as a 'single shot' attempt to restore equilibrium, and sufficient time must be allowed to lapse after each execution so that the system has returned to a steady state condition prior to the next execution. The dynamic control method anticipates the time dependent behaviour of the system and, by storing recent past actions, continuously corrects the system, even while the system is in transient response.

The main advantage of the preferred dynamic control is that the control loop can adjust for discrepancies when they appear rather than waiting for the system to settle. For systems with slow time response this is a considerable advantage. To work effectively the controller is programmed according to an estimate of the time dependent response of the target system. However, this only needs to be roughly approximated. The dynamic controller preferably runs on a fast decision loop. Noise on the input parameters could result in many small corrections being made that are completely unnecessary. For this reason the exemplary program includes a minimum threshold correction level before making a correction.

The main sources of time dependent behaviour include:

Given an instantaneous change in balance state of the machine, there will be a delay of a few revolutions to reach a steady state of vibration.

To compensate for instantaneous variation in sensor output, a forgetting factor type filter is applied to the load cell data acquisition, but this means that the averaged data also takes a number of revolutions to respond to a new vibration state.

Change in the balance state of the machine is never instantaneous; for example water addition may require from 0.1 to 60 seconds to occur and stabilise.

Water extraction from the load means the balance state of the machine may change quite rapidly as the spin speed increases.

In the spin cycle, the machine is intended to accelerate from 100 to 1000 rpm in about 3 minutes. The machine will almost certainly be in a state of transient response for the duration of this period. The present control program can respond to changes in the balance state of the machine without the machine ever being in a steady state condition.

For dynamic control the controller is programmed with an approximation of the time dependent behaviour of the machine. The controller is programmed to consider past balance additions when deciding on what corrections, if any, are to be implemented. For each water chamber the sum of an appropriately weighted past history of water addition can be considered to be 'effect in waiting'. The controller program anticipates that the effect of a certain quantity of added water is still to come through on the signals. To compensate for this the controller subtracts an estimated 'effect in waiting' from the present out of balance vector when deciding which valves should be on and which should be off.

To implement this the controller maintains a record of the recent past actions. The history required depends on the machine mechanics, the sensors, and the imbalance calculation algorithm. For example with the configuration described here the controller tracks at least the last 10 seconds of activity. Preferably the controller records the present action each second. This would be each time the control loop executes or the control loop may execute much faster and updates could be more frequent, but greater in number.

Figure 9:
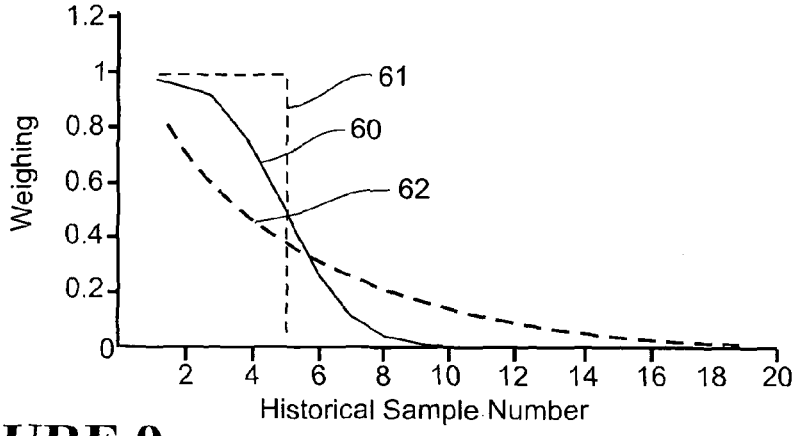
FIG. 9 is a graph illustrating weighting curves for estimating an anticipated balancing effect.

The controller may record a series of data points relating to the valves that are on at each loop cycle, and a table of weighting values. If we call this number of historical data points N, then to store the history of six control output channels (one channel per balance chamber) with N historical data points each requires 6N data points. Also, to then calculate the effect of this history will require 6N multiplications and 6N additions per loop cycle. One simplification would be to approximate the preferred weighting curve 60 with a 'table top' curve 61 as shown in FIG. 9. This then eliminates the need for a stored table of weighting values, and reduces the 6N multiplications to 6N additions.

An alternative embodiment uses a, negative exponential weighting curve 62 also shown in FIG. 9. For each water control channel, this is implemented by an "effect in waiting" variable. Each time the control loop executes, the effect in waiting variable is multiplied by a factor and an increment value is added to the variable if the water control valve for this channel was on during the last loop. This implementation only requires six multiplications and six additions with each control loop execution.

The factor is a forgetting factor, and is a value between zero and one. For example, this could be the effect of added balance water to be reflected in the calculated imbalance. Lower factors indicate rapid response. To avoid the need to have different forgetting factors dependent on speed, this part of the control loop could be executed on a per revolution basis. This is achieved by executing the balance correction algorithm once per rotation directly after the Imbalance Detection Algorithm. All quantities of water are calculated in terms of revolutions at the present speed rather than time, but this is a simple matter in that the magnitude calibration factor varies linearly with rotation speed.

If the out of balance load calculated for a drum end or a drum axial position is directly opposite one of the chambers at that end or axial position then the IDA will identify this chamber as the primary one needing water. However, the algorithm may also determine that one of the other chambers needs a small amount of water as well. This second water requirement may be much smaller than the other one. If the BCA addressed these secondary small water requirements then, over the relatively long period of addressing the primary chamber, the controller, as well as meeting the primary chamber requirements, will also gradually fill the other chambers. This would negate some of the water going into the primary chamber, and leave less headroom for further balancing corrections. Accordingly, in the exemplary embodiment, the balance controller does not address two chambers at once at one axial position of the drum.

Figure 10:
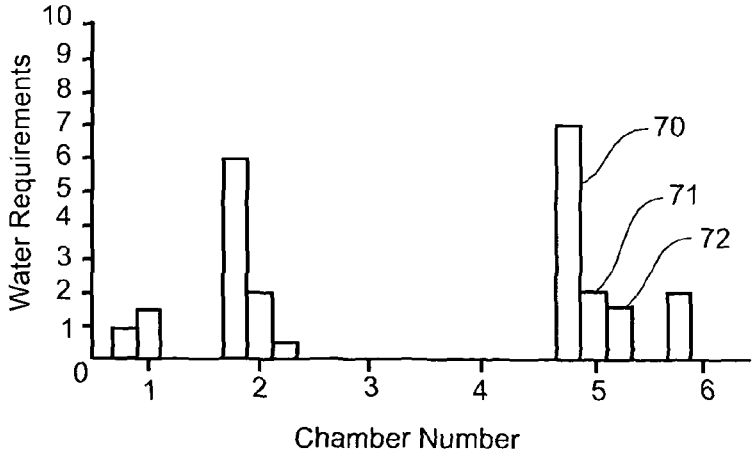
FIG. 10 is an illustration of the decision making process regarding filling of the balancing chambers.

The preferred controller is programmed to address this problem by identifying the maximum water requirement out of the six chambers and to then set a dynamic 'noise' threshold equal to half of this value of water. An example of this is illustrated in FIG. 10. In this example, for each chamber the left column illustrates the present demand resolved directly from the present imbalance. The centre bar indicates the present effect in waiting for that chamber. The right column indicates a value that is the present demand, less the dynamic noise threshold (half the greatest present demand), less the effect in waiting. So, in the example the present demand value 70 is 7. This also happens to be the highest demand value across the chambers so the dynamic noise threshold is set as 3.5 (0.5×7). The effect in waiting value 71 for chamber 5 is 2. The resultant 72 is 1.5 (7-3.5-2). A similar calculation is apparent for the other chambers showing a present demand value. Of these, only chamber 2 has any resultant. Following this calculation a valve will only be activated if the resultant for the chamber is above a further threshold value. This threshold is related to the amount of water that would be supplied before the next loop iteration. The exemplary controller performs a magnitude calibration by adjusting this threshold value in proportion to the drum speed.

A small amount of hysteresis is useful to prevent repetitive short valve actuations. This may be achieved by using the above criteria for deciding when to turn a valve on, but using different criteria when deciding to turn the valve off again. In the exemplary control program a water valve is turned off once its calculated present requirement is less than the value of its effect in waiting variable. Once the valve is on it is not turned off until its chamber requirements are addressed, although other valves may turn on and off in the interim.

Dynamic Balancing—BCA

The balance correction algorithm of FIG. 12 is now described in detail. This is only an exemplary embodiment, and any suitable algorithm may be devised that performs equivalent function of controlling acceleration of the drum from a moderate speed to a high speed while checking imbalance data, applying balance corrections based on the imbalance data, so that the balance correction reduces the imbalance continuously allowing the drum to accelerate to higher speeds.

The balance correction algorithm shown in FIG. 12 begins at step 1201. The method proceeds at steps 1203 to 1209 with calibration of the phase information from the IDA. The step 1203 of vector rotation is optional depending on the method used (one alternative is to apply an offset to the sine table). This step translates the orthogonal vectors for each end to be two vectors at 60 degrees apart. A third vector for each end, 60 degrees apart from each of the other two is generated at step 1205. At step 1207 the vectors are normalised. At step 1209 the out of balance vectors are calculated. These steps are detailed more fully below with reference to the IDA.

At step 1211 the method checks if a balance correction enable flag is true. This is set at step 1317 of the method of FIG. 13, and potentially disabled at step 1323 of FIG. 13 or step 1215 of FIG. 12. If the flag is true then the method proceeds to step 1213. Otherwise the method exits at step 1243, to be re-executed in the next cycle.

If the flag is true, then at step 1213 the method checks whether the magnitude of the vectors is below a predefined critical limit (a level that is considered potentially hazardous). If the magnitude of the vectors exceeds the threshold the method proceeds to step 1215, and stops bowl rotation, turns of all balancing valves, sets the balance correction flag to false and reports an error to a main control algorithm. The main control algorithm may be programmed to respond to such an error with a user alert. If the magnitude of the vectors is below the threshold then the method proceeds to step 1217.

At step 1217 the method checks whether the "hold bowl speed" flag is true. This flag is set by a previous iteration of the method of FIG. 12—at steps 1225 and 1239. If the flag is true then the method proceeds to step 1219. If the flag is false the method proceeds to step 1223.

At step 1219 the method checks whether the magnitude of the vectors is less than a lower threshold level. If so the method proceeds to step 1220 and resets the hold bowl speed flag to false and then proceeds to step 1227. Later in the method this will allow the drum to accelerate—if the bowl is not already at full speed. Otherwise the method proceeds directly to step 1227, leaving the hold bowl speed flag set as true. Later in the method this will mean that the bowl speed is maintained at the present level. In effect the bowl will not be allowed to accelerate until the vibration is below the lower threshold, at which point the flag is set false by step 1220.

Alternatively, if the hold bowl speed flag was false at step 1217, then at step 1223 the method checks whether the vibration is greater than an upper threshold level. If not then this indicates that the vibration level is acceptable and the drum can continue to accelerate (if it is not already at the maximum speed), and the method proceeds to step 1227. If the vibration is greater than an upper threshold level the method proceeds to step 1225, and sets the hold bowl speed flag to true. This stops further acceleration until the test of step 1219 is satisfied in later iterations of the method. The method then proceeds to step 1227.

At step 1227 the method selects a balance correction rate (for example whether to activate low or high flow rate to valves) to apply based on the magnitude of the vibration. The method then proceeds to step 1229.

At step 1229, the method updates the effect in waiting values to reflect the active valves for the most recent cycle. The method adds to the effect in waiting values for those vectors for which an equivalent balance valve has been open since the previous cycle. This increment is adjusted to reflect the balance correction rate that applied in the last cycle. The method then proceeds to step 1231.

At step 1231 the method compares each current balancing demand vector against the effect in waiting for that vector, and decides whether to open or close the respective valve. In particular the method selects the largest demand vector for each set of balance chambers. For that vector, if the nett value (the current balancing demand less the effect in waiting value) is greater than a threshold value then the valve is set open. If the nett value is less than the threshold then the valve is set closed. No action is taken in relation to the smaller vectors. The method then proceeds to step 1233.

Steps 1233 to 1241 perform the actual speed control according to the present speed and the hold bowl speed flag. At step 1233 the method checks the hold bowl speed flag. If the flag is true the method proceeds to step 1235 and maintains the present bowl speed. If the flag is false the method proceeds to step 1237.

If the hold bowl speed flag was false at step 1233, then at step 1237 the method checks whether the present bowl speed is equal to or above the target speed. If the bowl speed is equal to or above the target speed then the method proceeds to step 1237 and sets the hold bowl speed flag to true, and sets the acceleration to zero. By this step the method limits the top speed of the spin cycle to the target bowl speed. If the bowl speed is lower than the target speed at step 1237 the method instead proceeds to step 1241 and sets a positive value for the acceleration, allowing the bowl speed to increase.

After each of steps 1235, 1239 or 1241 that iteration of the method exits at step 1243. The method will be executed again in the next cycle. The BCA method may be executed again immediately, or may be executed after a slight delay—for example the method may be executed once per second.

According to this method the BCA controls acceleration of the drum, and controls balance correction during acceleration, and while the drum is held at various speeds lower than or equal to the target speed. If the balance grows to a dangerous level, before or after reaching the target speed, the BCA will terminate the spin cycle at step 1215 in the next iteration of the loop.

Signal Analysis—IDA Processing

To determine the imbalance in the load the IDA calculates the magnitude and phase angle of the once per rotation sinusoidal component in each of the signals. Unfortunately the signal does not look like a clean sinusoid, but is messy due to structural non-linearities in the machine as well as radio frequency interference (RFI). The controller program determines the once per rotation component or 'fundamental component' by digitally sampling the signal and using the discrete Fourier Transform technique. The preferred implementation does not compute an entire transform, but just the fundamental component. For example this may be done by multiplying each of the signal data points by the value of cosine wave (of the drum rotation frequency) at the equivalent phase angle lag after a rotational reference mark, summing each of these results over a whole revolution, and then dividing by the number of results. This gives one (eg: the x-axis) component of the vector result. The imaginary (or y) component is derived using the same technique but using sine wave valves instead of cosine wave valves. The resulting values may then be converted to polar form, giving magnitude and phase angle of the fundamental component in the signal relative to the reference mark.

The program may use any known method of deriving the magnitude and phase of the fundamental component of the sensor data. The example described is only one common technique.

In the preferred embodiment, to prevent aliasing, the input signal is passed through an analogue filter before processing to remove frequency components higher than half of the sampling frequency.

The discrete Fourier analysis is straightforward if the sampling is performed using a fixed number of samples per revolution rather than a fixed frequency. This requires rotational position data, which in this application is available from the motor controller. In the exemplary embodiment the controller samples a number of points per revolution that divides exactly into the number of commutations per revolution executed by the motor. The sine values for the positions are stored as a table. The program retrieves the cosine values from the same table by offsetting forwards by a quarter of the number of samples per period.

Figure 8:
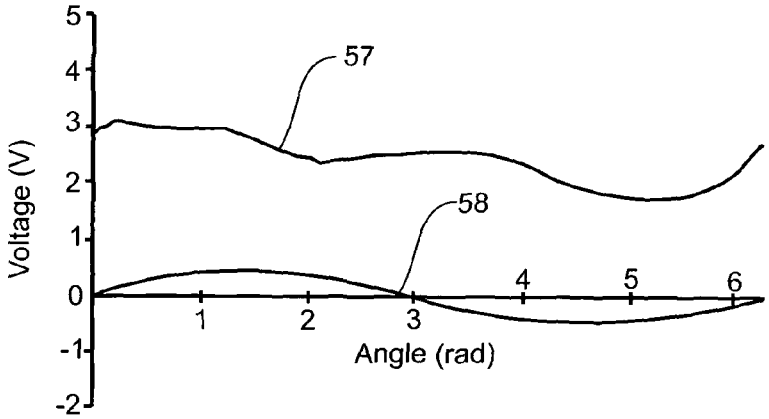
FIG. 8 is a waveform diagram giving example output waveforms from the vibration sensors.

Having a reasonable number of sampling points per revolution is useful so that the order of harmonics that are aliased onto the fundamental component is well beyond the cut-off frequency of the low pass filter. Preferably the number of sampling points is at least 12 per revolution to obtain reliable sampling at speeds upwards of 200 rpm. Preferably there are an even number of points per revolution for sampling so that the sine table is perfectly symmetrical—the positive sequence and the negative sequence are identical apart from their sign. This ensures that the DC offset on the input signal does not influence the fundamental component. FIG. 8 illustrates the signal after filtering 57 and the extracted fundamental component 58.

Alternatively, if a sufficiently powerful microprocessor is available then by maximising its data acquisition capabilities the noise problem may be further reduced. This would mean instead of fixed sampling on a per revolution basis, it could be on a fixed frequency basis—at a higher rate. The sine and cosine values could be either calculated or interpolated from a table, which simplifies much of the calculation.

Once the fundamental component of each of the source signals is obtained, the fundamental components will inevitably contain some noise component. Consecutive measurements will still have some variance. To minimise this variance the preferred signal source is accurate, clean, and has linear response. The program preferably uses averaging techniques to address any remaining noise.

In the example embodiment the control processor is programmed to implement a 'Forgetting Factor'. Every time a new measurement is acquired a new average is equal to a percentage of the old averaged value plus a reciprocal percentage of the new measurement. For example with a forgetting factor of 0.3, 0.3 of the old average is subtracted and replaced by 0.3 of the new measurement. This form of averaging suits a microprocessor based application since it is inexpensive with respect to both memory space and processor time.

The main disadvantage with averaging the measurements in this way is that the response time of the imbalance detection is reduced. The averaged result incorporates several measurements in order to reduce the noise. The lower the forgetting factor, the more the averaged value remembers from past measurements, and the more stable the value is, but the control responds slower to a change in machine vibration.

An example algorithm implementing this process is given in FIG. 11. The method is executed repeatedly as a loop. The method is preferably repeated at predetermined intervals. The rate of repeat is controlled by the waiting loop at step 1102.

The method begins at step 1101 and proceeds to step 1102. At step 1102 the method waits for the once per rotation sensor to detect the end of a full drum rotation. The method then proceeds to a main data acquisition loop of steps 1103 to 1109.

At step 1103 the method reads data received and buffered from the sensor package 42 over the last drum rotation into a stored data block (memory) for further processing. This data is a series of values for each sensor spaced over the time period of the last revolution of the drum. This step frees the buffer to begin storing sensor data from the next revolution of the drum.

The method proceeds to step 1105 and reads the next sample set from the data block. In the first iteration of this loop the method reads the first sample set from the data block. The sample set includes values from all six sensors—four acceleration and two force sensors.

The method proceeds to step 1106 and multiplies each value by values from the sin and cosine tables according to the respective angular position of the drum at the time the sensor value was read from the sensor. This divides the force and acceleration inputs into two orthogonal components referenced to the drum. Subsequent samples in the data block will be converted in the same way to reference against the drum, and so the converted samples can be directly averaged together.

The method proceeds to step 1107 and adds the results from step 1106 to a running integration for each component.

The method proceeds to step 1109, where it either loops back to step 1103 if there are more sensor data values to process, or proceeds on to step 1111 if all of the values in the data block have been processed.

At step 1111 the method processes the transformed and averaged (integrated) sensor input from step 1107 to produce out of balance vectors. This calculation of the out of balance forces is described in detail below.

The method then proceeds to step 1113 and resets the running integration used in loop 1103 to 1109.

The method proceeds to step 1114 and calls the BCA of FIG. 12. The method then loops back to start again at step 1101.

The imbalance of a load changes as water is extracted so balancing must be achieved over a long period. Accordingly we do not consider it necessary to be able to obtain a perfect balance in one 'hit'.

In the described embodiment the measurement data is processed to produce vectors in cartesian format (x & y), whereas the possible balancing responses are in polar format (magnitude & phase). While it could be possible to perform a format conversion conventionally, the exemplary control program adopts a more efficient approach. The phases of the response are incorporated directly into the discrete Fourier technique as offsets each of an integer number of points when referencing the table of sine values. These offsets are adjusted as the machine changes speed for phase angle calibration. Alternatively phase calibration may be performed using a rotation matrix acting on the vectors as calculated without any applied offset to the sine table. Magnitude calibration however, is performed later in the dynamic control routine. In the example control program illustrated in FIGS. 11 to 13 this step is implemented in the BCA of FIG. 12, at steps 1203.

After obtaining an imbalance vector for each set of balance chambers, the IDA calculates how much water each chamber at each end needs. The chambers of the preferred embodiment are 120 degrees apart. The machine could include four chambers at each end 90 degrees apart, (i.e. orthogonal like the x and y axes) and then these would be the x and y components already calculated in the Fourier transform. However this would require four chambers for each end and thus two more water control valves and associated drivers. In the exemplary embodiment the control processor calculates the projection of the signal vector onto axes that are 120 degrees apart, the same as the chambers.

The described Fourier technique uses sine and cosine wave forms to extract the orthogonal x and y projections. This follows quite naturally from the fact that a cosine wave is a sine wave that is has been shifted by 90 degrees. To split the signal vectors into projections that are 120 degrees apart the control program performs a similar calculation replacing the cosine wave form with a sine wave form that has been shifted by 120 degrees.

The phase calibrated signals now represent the projection of the imbalance onto the first two chambers. The control program finds the projection of the imbalance onto the third chamber using the vector identity that the sum of three vectors of equal magnitude and all spaced 120 degrees apart must be equal to zero. Hence the sum of all three projections must be zero, and the projection onto the third chamber is the negative of the sum of the projections onto the first two chambers.

By adding half a rotation to the response phase angles the three values obtained are made to represent the projection of the restoring water balance required onto each balancing chamber. In the BCA method of FIG. 12 described earlier this action is implemented at step 1205.

Finally, at least one of these three projections will be negative, representing water to be removed from that chamber. This cannot be done in our present balancing system. Instead the control program adds a constant to all three numbers so that the most negative number becomes zero and the other two are positive. In the BCA method of FIG. 12 described earlier this action is implemented at steps 1207

Alternatively the control processor program may assume that the chamber whose angular extent includes the imbalance vector (or which is closest to the imbalance vector) will receive no water. The correction vectors for the other two chambers then should add to the imbalance vector to give zero.

The direction of these vectors is assumed to be radial toward the centre of the respective balance chamber arc. The magnitudes of the vectors are easily calculated by trigonometry.

Calculating the Out-of-Balance Force

Thus far we have not described in detail how the control processor calculates the out of balance force from the force sensor inputs, compensated for machine movement and drum precession.

Figure 14:
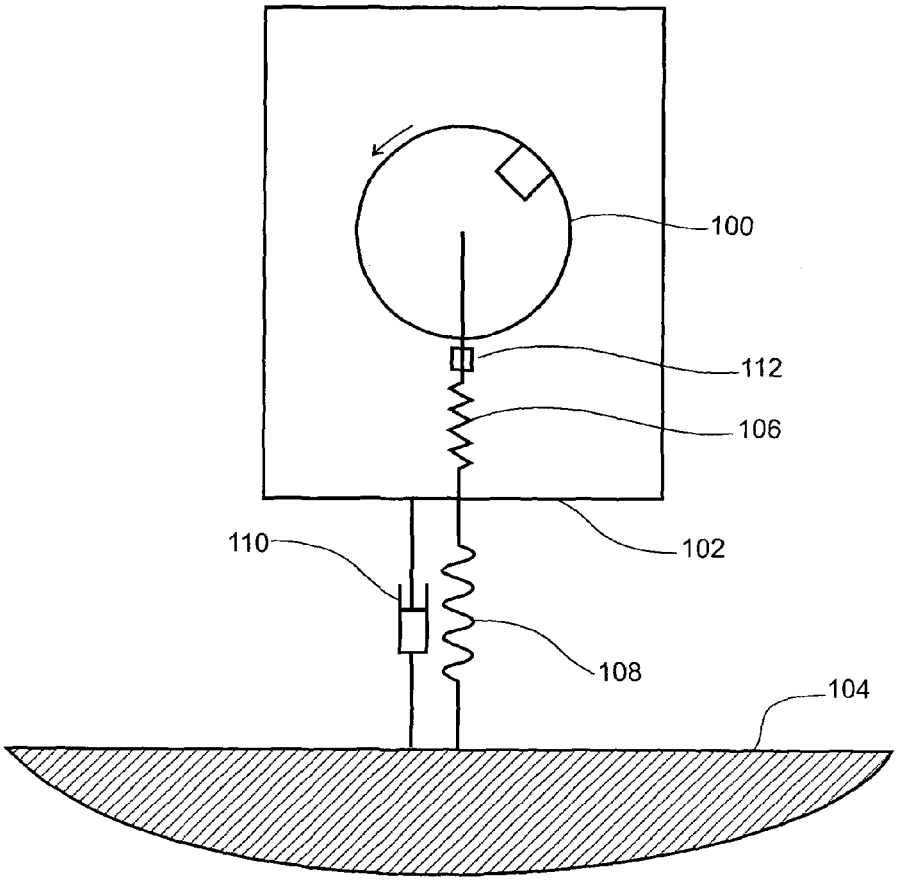
FIG. 14 is a block diagram of an equivalent spring system when the laundry appliance is supported on a flexible floor.
Figure 15:
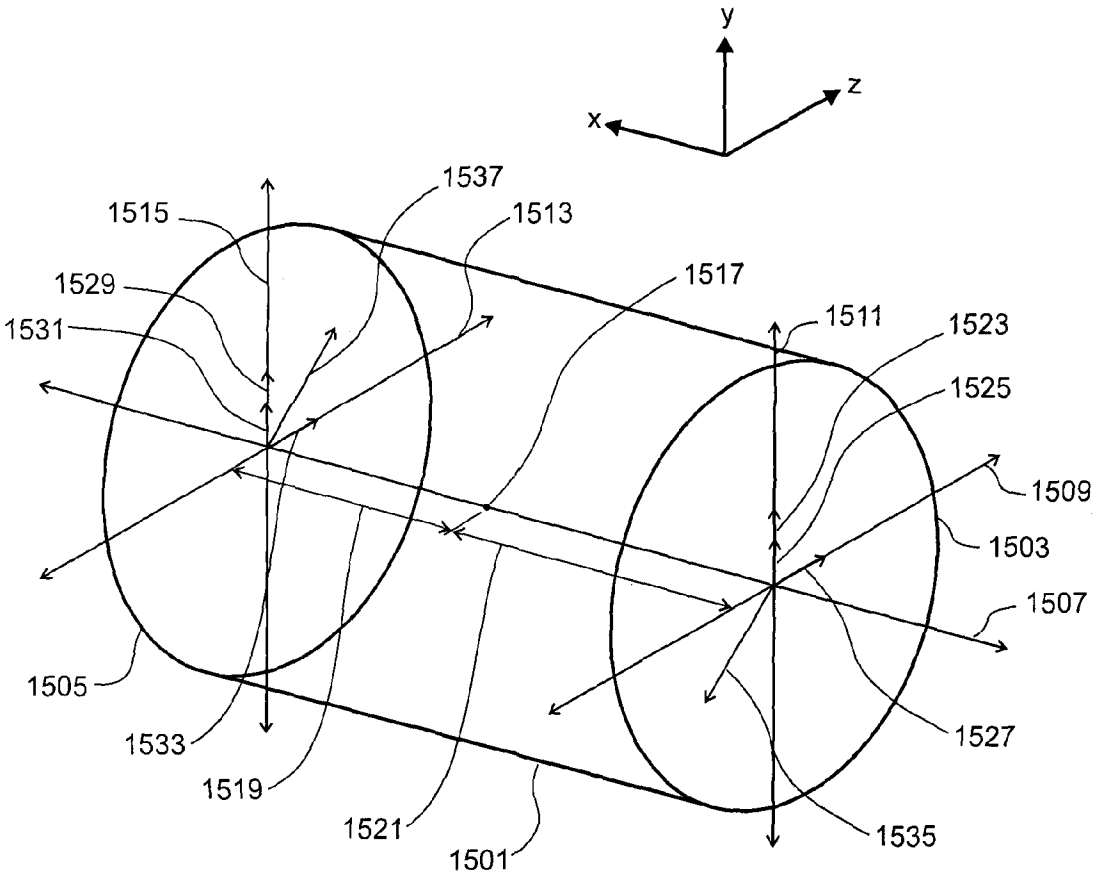
FIG. 15 is a diagram illustrating the terms of an improved imbalance calculation according to the preferred embodiment of the present invention.

The equivalent spring system which represents the spin drum 100, the machine frame 102 and the reference surface is shown in FIG. 14. The first spring 106 between the spring drum 100 and the machine frame 102 effectively represents the elasticity of the load bridge which connects the bearing mount to the drum support or frame of the washing machine. This bridge also forms the basis of the load cell which measures the forces between the drum and the frame of the washing machine. The second spring component 108 in this case represents the elasticity of the support surface, for example, flexible wooden floorboards, and the machine frame. The second spring 108 is complex and includes a damping component 110.

In the exemplary embodiment of the invention the sensor package measures the acceleration or displacement of the drum 100 at each end relative to the reference surface 104. For example an accelerometer 112 is connected either to a non-rotating part of the bearing itself or on an adjacent section of the load cell bridge. This accelerometer at each end bearing measures accelerations in a vertical plane perpendicular to the drum axis. A sensor package also measures angular movement in a horizontal plane parallel with the drum axis. In the exemplary embodiment this horizontal plane includes the drum axis. A sensor at each bearing measures acceleration on a single axis in this horizontal plane, this axis being perpendicular to the drum axis.

Our U.S. Pat. No. 6,477,867 describes a balancing system that is capable of practical implementation and works acceptably up to moderate speeds, for example up to 1000 rpm. The entire content of U.S. Pat. No. 6,477,867 is hereby incorporated by reference. However a continuing desire for efficiency and more rapid wash cycles demands ever greater spin speeds. Speeds up to 1400 rpm and beyond are now considered desirable, even with a drum diameter as large as 500 mm.

The inventors have continued to develop the active system and have discovered additional physical effects that become significant at these heightened speeds. These effects are not observed in every wash load but will occur occasionally. A practical machine must work safely for nearly every wash load.

Learning systems such as described in U.S. Pat. No. 5,561,993, may prove capable of correcting for these issues without recognising the issues themselves. However these systems are believed to require a steady operating state, or at least an operating state that does not change at a pace that is more rapid than the repetition rate of the system. The inventors believe that these systems are not capable of operating effectively at the speeds where the effects noted above become significant. At these speeds small out of balance masses create large forces and these forces can change the system conditions. At these rotational speeds correction speed and accuracy are important to keeping the balance forces under control. Failure at these speeds is also potentially dangerous so the control must be able to react correctly to all possibilities. These include external forces disturbing the system. Disturbances might include a person leaning against the machine or placing a load on the machine, or starting another nearby appliance that provides movement in the surrounding environment. Learning systems, inherently or explicitly, develop a model of the physical system using data from preceding balance operations. In sophisticated learning systems the model progressively updates, but this takes iterations of the balance process. In this process the control will inadvertently correct for imbalances that do not actually exist and potentially worsen the situation. The time and tolerance for this process is not desirable at the high speeds now contemplated.

Instead the inventors have devised a control that reliably corrects for these external disturbances in the out of balance calculations.

Prior art systems are believed to not be capable of reacting appropriately to the situations that a system according to any of the present inventions correct for. In particular the system previously described in U.S. Pat. No. 6,477,867 fails to correct for the influence oscillation of the support structure in a horizontal plane has on the detected forces. The system described in U.S. Pat. No. 6,477,867 also fails to correct for the influence that flexing of the rotating drum structure has on the detected forces.

Summary of Prior Art Active System Model

Previously proposed active systems are distinguished from learning systems in that they implement a predetermined model of the operating force system. Force and acceleration date are provided as inputs to the algorithm implementing this model. The model outputs out of balance vectors or recommended balance correction data.

The most sophisticated prior active system for washing machines is disclosed in U.S. Pat. No. 6,477,867. The basic model implemented there uses a force sensor at either drum end. The model determines the out of balance force for each end as the rotating vector of the force sensor input waveform that is synchronised with the drum rotation.

The more complete model described in U.S. Pat. No. 6,477,867 uses an additional accelerometer at each drum end. The accelerometer acts on the same axis as the force sensor measures movement of the support structure immediately adjacent the support axis of the drum. The model corrects the out of balance calculation by subtracting the direct forces applied by the moving support structure.

Improved System According to the Present Invention

The present invention derives from a more complete theoretical understanding of the mechanical system. The out of balance forces within the body can be combined with the suspension forces at the bearings to give equivalent effective total forces $\underset{\sim}{f}_1$ and $\underset{\sim}{f}_2$ applied at the two ends. The accelerations $\underset{\sim}{a}_1$ and $\underset{\sim}{a}_2$ are a result of the applied forces and the spinning motion of the body.

The new control accounts for several factors that were not accounted for in the prior art theory.

Full Control Calculation

According to the exemplary embodiment the effective out of balance to be corrected by additions at the two balance locations are found from:

$$\begin{pmatrix} f_{00B1} \\ f_{00B2} \end{pmatrix} = [C]\begin{pmatrix} f_{1y} - f_{1suspy} \\ f_{2y} - f_{2suspy} \end{pmatrix}$$

$$\text{where } [C] = \frac{1}{l-(x_1+x_2)}\begin{bmatrix} l-x_2 & -x_2 \\ -x_1 & l-x_1 \end{bmatrix}$$

Where:

$$\begin{pmatrix} f_{iy} \\ f_{2y} \end{pmatrix} = [M]\begin{pmatrix} a_{1y} + i\frac{I_{xx}}{I_{rr}}\frac{l_1}{l}(a_{2z}-a_{1z}) \\ a_{2y} - i\frac{I_{xx}}{I_{rr}}\frac{l_2}{l}(a_{2z}-a_{1z}) \end{pmatrix}$$

$$\text{where } [M] = \begin{bmatrix} \frac{1}{m}+\frac{l_1^2}{I_{rr}} & \frac{1}{m}-\frac{l_1 l_2}{I_{rr}} \\ \frac{1}{m}-\frac{l_2 l_1}{I_{rr}} & \frac{1}{m}+\frac{l_2^2}{I_{rr}} \end{bmatrix}^{-1}$$

And the locations of the balance correcting systems are inboard of the locations of the force sensors by $x_1$ and $x_2$ "Inboard" here means in a direction toward the other force sensor. If the balance correcting system is located in a direction away from the other force sensor the value will be negative. For a front loading machine where both bearings are fitted to a single shaft at one end, the relationship holds. The sensor package associated with each bearing is assigned and mapped to one of the drum end correction locations by appropriate setting of $x_1$ and $x_2$.

For a physical system, such as the top loading system described earlier, where the drum is suspended in line with the location for applying correction mass, this can be simplified to:

$$\begin{pmatrix} f_{00B1} \\ f_{00B2} \end{pmatrix} = [M]\begin{pmatrix} a_1^1 \\ a_2^1 \end{pmatrix} - \begin{pmatrix} f_{1suspy} \\ f_{2suspy} \end{pmatrix}$$

Where:

$$a_1^1 = a_{1y} + i\frac{I_{xx}}{I_{rr}}\frac{l_1}{l}(a_{2z}-a_{1z})$$

$$a_2^1 = a_{2y} - i\frac{I_{xx}}{I_{rr}}\frac{l_z}{l}(a_{2z}-a_{1z})$$

And:

$$[M] = \begin{bmatrix} \frac{1}{m}+\frac{l_1^2}{I_{rr}} & \frac{1}{m}-\frac{l_1 l_2}{I_{rr}} \\ \frac{1}{m}-\frac{l_2 \ell_1}{I_{rr}} & \frac{1}{m}+\frac{l_2^2}{I_{rr}} \end{bmatrix}^{-1}$$

Definition of Variables and Constants in the Formulae

The following list describes the variables and constants used in the above formulae. The list also summarises how these can be derived from the outputs of the collection of sensors described in relation to the preferred physical embodiment. In many cases these variables could be derived from other sensor types or from other combinations of sensor output. Furthermore, sensors could be located at different axial locations, or at locations away from the spin axis of the drum, and equivalent values could be derived for the variables by suitable spatial transformations. In some cases this would require additional sensors to derive sufficient data. In other cases the data would not be as accurate as the data provided by sensors that are grouped together, on or very close to the spin axis of the drum. This preferred arrangement reduces unnecessary calculations.

If the sensor groups can be provided at the axial locations of the balance correction systems then this further simplifies the required calculations. This is practical for a drum supported at both ends, but is not practical for a drum having cantilever support.

Measured Variables—Force and Acceleration:

$f_{1suspy_DC}$=(scalar) DC value of suspension force at drum support $S_1$, measured by force sensor at $S_1$ $f_{2suspy_DC}$=(scalar) DC value of suspension force at drum support $S_2$, measured by force sensor at $S_2$ $f_{1suspy}$=(vector) AC component of suspension force at drum support $S_1$, measured by force sensor at $S_1$ $f_{2suspy}$=(vector) AC component of suspension force at drum support $S_2$, measured by force sensor at $S_2$ $a_{1y}$=(vector) acceleration in the vertical direction, measured by accelerometer at $S_1$ $a_{2y}$=(vector) acceleration in the vertical direction, measured by accelerometer at $S_2$ $a_{1z}$=(vector) acceleration in the horizontal direction (perpendicular to the drum axis), measured by accelerometer at $S_1$ $a_{2z}$=(vector) acceleration in the horizontal direction (perpendicular to the drum axis), measured by accelerometer at $S_2$ Constants, Defined by Geometry of Drum:

$x_1$=distance that the balance force is applied inboard from support 1

$x_2$=distance that the balance force is applied inboard from support 2 l=distance between drum supports $S_1$ and $S_2$

Calculated Variables:

$$m = \text{total mass of drum and load} = \frac{(f_{1suspy_DC} + f_{2suspy_DC})}{g}$$

$l_1$=distance from drum support $S_1$ to the centre of gravity of the drum and load, where $$l_1 = \frac{f_{1suspy_DC}}{\text{mg}} l$$

$l_2$=distance from drum support $S_2$ to the centre of gravity of the drum and load, where $$l_2 = \frac{f_{2suspy_DC}}{\text{mg}} l$$

$I_{xx}$=moment of inertia of the drum about the axis of rotation (x-axis), where $I_{xx}=ml_{xx}^2$, and $l_{xx}$=radius of gyration of drum about the axis of rotation, assumed to be a constant (relative to diameter of drum)

$I_{rr}$=moment of inertia of the drum about any diametric axis (i.e. an axis in x-y plane), where $I_{rr}=ml_{rr}^2$, and $l_{rr}$=radius of gyration of drum about any diametric axis, assumed to be a constant (relative to length of drum)

$f_{1y}$, $f_{2y}$=(vectors) calculated forces that, when exclusively applied at S1 and S2 respectively, would cause the acceleration of the drum observed $f_{OOB1}$, $f_{OOB2}$=(vectors) calculated forces that, when applied at their stated locations (inboard of S1 and S2 by $x_1$ and $x_2$ respectively) in conjunction with $f_{1suspy}$ and $f_{2suspy}$ applied at S1 and S2 respectively, would be equivalent in action to $f_{1y}$ and $f_{2y}$ Coupling The system described in U.S. Pat. No. 6,477,867 assumed that either end of the drum could be measured and corrected independently. The inventors subsequently discovered a limitation of this approach. An acceleration acting of one end of the drum would create measured forces at both ends of the drum. The reaction force at one drum end would act around the centre of mass of the drum to require an equivalent reaction force at the other drum end. The relationship between these forces depends on the location of the centre of mass of the rotating drum assembly. The algorithms presented here fully account for this coupling. In the calculations described above coupling is accounted for by use of the mass matrix M in converting calculated accelerations to the corresponding forces.

Gyroscopic and Precession Effects

Conservation of angular momentum requires that the sum of applied moments is equal to the time rate of change of the product of the inertia tensor with the angular velocity vector. In global coordinates, the inertia tensor changes as the drum revolves. The inventors realized that as a result, for rotating bodies, rotational motions about the two axes orthogonal to the main rotational axis (in this case rotational motions about the two diametric axes, y and z) become coupled: moments applied about one diametric axis can cause rotational motion about the orthogonal diametric axis. The inventors realized that this is a source of error when accounting for vertical accelerations of each support location.

The full derivation is not required for implementing the present control. However, starting with an inertia tensor of the form $$[I] = \begin{bmatrix} I_{xx} & 0 & 0 \\ 0 & I_{rr} & 0 \\ 0 & 0 & I_{rr} \end{bmatrix}$$

and with an angular velocity vector of the form $$\omega = w\begin{pmatrix} 1 \\ \varepsilon_y \\ \varepsilon_z \end{pmatrix}; (\varepsilon_y, \varepsilon_z) << 1$$

where $\epsilon_y$ and $\epsilon_z$ are small compared to unity, and eliminating second and higher order terms as they appear, the inventor arrived at the relationship $$\begin{pmatrix} f_{1y} \\ f_{2y} \end{pmatrix} = [M]\begin{pmatrix} a_{1y} + a_{1y}(\text{gyroscopic}) \\ a_{2y} + a_{2y}(\text{gyroscopic}) \end{pmatrix}$$

-continued $$\text{where } [M] = \begin{bmatrix} \frac{1}{M} + \frac{l_1^2}{I_{rr}} & \frac{1}{M} - \frac{l_1 l_2}{I_{rr}} \\ \frac{1}{M} - \frac{l_2 l_1}{I_{rr}} & \frac{1}{M} + \frac{l_2^2}{I_{rr}} \end{bmatrix}^{-1}$$

and $$\begin{pmatrix} a_{1y}(\text{gyroscopic}) \\ a_{2y}(\text{gyroscopic}) \end{pmatrix} = \frac{I_{xx}}{I_{rr}}\omega(V_{2z} - V_{1z}) \begin{pmatrix} \frac{l_1}{l} \\ \frac{-l_2}{l} \end{pmatrix}$$

When considering a frequency component "ω" the z-axis velocities can be substituted by the z-axis accelerations, using the formula $(V_{2z}-V_{1z})=(a_{2z}-a_{1z})/i\omega$. It should be noted that the machine is stationary so the velocity is assumed oscillatory, and the velocity can be fully derived from the acceleration. This transformation has been applied in the preferred calculation.

Exemplary Embodiment

The following summarises the exemplary embodiment of a laundry machine incorporating the present invention. This embodiment is a top loading machine where the drum is supported at both ends, however the invention is equally applicable to front loading machines where the drum is supported from one end.

The laundry machine includes a cabinet or external wrapper. Some of the cabinet may be a framework, some may be formed as sheets or panels.

A support frame for a drum is located inside the cabinet at least for operation. The support frame includes a watertight enclosure. The enclosure has a sump. The watertight enclosure may be entirely covered by the frame, or partly formed by parts of the cabinet.

A drum inside the enclosure has a shaft protruding from either end. Each shaft is supported on the support frame to rotate about a horizontal axis.

A hatch is provided in the sidewall of the drum. The preferred hatch includes a latch along both axially oriented edges, so that the hatch can open in a circumferential sliding movement.

The machine uses a tilt open configuration, where the support frame pivots or rolls or slides forward to provide an access opening to the drum. This allows the machine to be located under a bench. An alternative form would have a top opening in the cabinet.

Bearings for supporting the drum shafts are rigidly, or substantially rigidly, supported in the support frame. The bearings may be supported in bearing mounted in each external end of the watertight enclosure.

A first force sensor at a first one of the bearings senses vertical force on the bearing of a first end of the drum. A second force sensor at a second one of the bearings senses vertical force on the bearing of a second end of the drum.

A first vertical accelerometer at the first bearing senses vertical acceleration of the first bearing. A second vertical accelerometer at the second bearing senses vertical acceleration of the second bearing.

A first horizontal accelerometer at the first bearing senses horizontal acceleration of the first bearing transverse to the spin axis of the drum. A second horizontal accelerometer at the second bearing senses horizontal acceleration of the second bearing transverse to the spin axis of the drum.

One drum end includes first balancing chambers distributed around the periphery of the drum end. The balancing chambers are preferably located at the same axial location as the first bearing. This resolves the need to apply an extra transformation to the sensed or calculated forces. First water supply paths selectively supply water to selected first balancing chambers under the control of an associated balance control valve for each water supply path.

The other drum end includes second balancing chambers distributed around the periphery of the drum end. The balancing chambers are preferably located at the same axial location as the first bearing. Again, this is to resolve the need to apply an extra transformation to the sensed or calculated forces. Second water supply paths selectively supply water to selected first balancing chambers under the control of an associated balance control valve for each water supply path.

A once-per-rotation sensor is provided between the drum and the non-rotating structures. The drum has a magnet located at one location offset from the axis. A rotation sensor is fixed to the support frame for detecting the magnet and providing an output indicating absolute angular position of the drum once per revolution.

The drum may be rotated by a direct drive rotor. The drum could alternatively be rotated by a belt drive. The preferred direct drive motor has a rotor fixed to one of the shafts protruding from the drum, and a stator fixed to an end of the enclosure. The bearing and sensors are encompassed by the stator.

A latch between the support structure and the enclosure is operable to a locked position to stop the support structure opening when the machine is in a cycle. Operation of the latch is controlled by a central controller which includes a software lockout that doesn't release the latch unless the drum is stationary.

A wash and rinse water supply supplies water to the watertight enclosure. The water supply path may include a rinse through a dispenser for dispensing additives.

A wash recirculation or drain pump receives water from a sump of the washer. The preferred pump has a first mode where water is discharged into the drum through an axis of one of the drum supporting shafts and a second mode where water is discharged to the drain hose. Alternatively, a separate pump could be included for each mode.

A water level sensor, preferably a pressure sensor, is located in the sump.

A water heater and a water temperature sensor are also located in the sump.

A balancing water supply supplies water to balance control valves. The balancing water supply preferably has a controlled pressure. This may be provided by a pressure regulator. Alternatively, the balancing water supply could have a pressure sensor or a flow sensor.

A user interface allows users to selecting wash programs and start and pause controls. The user control interface may include indicator lights, a suitable display screen, entry devices such as dials, an entry pad, a touch screen or any combination of these. The user interface may provide for remote control. For example via a modem, LAN or wireless networking interface.

Referring to FIG. 7, a controller 51 (which may include more than one controller, may be central or distributed, may be split between hard electronics, configured or configurable logic, and software executing on a computer, in any combination) receives inputs from:

the user interface 24 feedback from the power supply 713 the pressure sensor of the pressure controller 717 the pressure sensor 709 of the sump the temperature sensor 711 of the sump the once per revolution sensor
feedback 52 from the drive motor
feedback from the latch 707
feedback from the sump pump 703
the two force and accelerator sensors 42.
The controller provides control signals to:
the user interface 24 (for displaying menu choices and providing wash program information)
the power supply 713
the power supply switches 719 for the drive motor
a switch for activating the heater
the power supply switches 53 for each balancing valve 54
the switch for the controlled pressure inlet valve 715
the switch for the main water inlet valve 401 for the dispenser (and any switch for selecting the dispenser channel)
the power supply switches for the wash pump 703 (and any switch for selecting the pump mode).

In operation the controller turns the balance valves on and off to balance the drum in each spin cycle, after calculating the required balance requirements from the force and acceleration sensors. The algorithm uses a physical model of the machine dynamics and calculates an absolute balance correction vector for each end, including accounting for "gyroscopic" effects—accelerations that are being created (or resisted) in the vertical direction at each drum end due to rotation (typically oscillation) of the rotating drum in the horizontal plane. This oscillation is estimated from the horizontal accelerations of each end. The oscillation is then converted to vertical drum end force/acceleration using a term that relates to conservation of momentum/gyroscopic effect. This nominal acceleration effect is applied as a correction to the measured vertical acceleration.

The corrected vertical accelerations are used to correct the measured forces. The corrected accelerations are converted using a mass term that accounts for coupling: a force applied at one end results in a force at either end due to moments around the centre of mass of the drum.

This requires some knowledge of the centre of mass of the drum. This knowledge is derived from the static component of the vertical forces.

The sensed vertical forces are processed to procure the magnitude of the cyclical component at the measured drum speed (using either motor feedback or the once per rotation sensor), and the phase angle of the peaks of the cyclical component relative to a known rotational position on the drum. The sensed vertical force for each end is also averaged over one or more complete cycles to indicate the actual weight carried by the bearing at each end.

The sensed vertical accelerations are processed to procure the magnitude of the cyclical component at the measured drum speed (using either motor feedback or the once per rotation sensor), and the phase angle of the peaks of the cyclical component relative to the same known rotational position on the drum.

The sensed horizontal accelerations are processed to procure the magnitude of the cyclical component at the measured drum speed (using either motor feedback or the once per rotation sensor), and the phase angle of the peaks of the cyclical component relative to the same known rotational position on the drum.

The balance correction vector is then a phase angle and magnitude relative to the known rotational position on the drum. This vector indicates the required correction, however the system is dynamic as water is continuously extracted. Accordingly only the valves for one chamber at each end are operated at a time. This will correspond with the chamber where the vector falls.

The balance correction vector can be translated to component vectors for each chamber (with one vector zero and two vectors balancing depending on the relative directions). These vectors indicate the balance demand. A valve will be opened when the maximum balance demand (less any effect in waiting) exceeds a predefined threshold. Effect in waiting is a moving window accumulation or forgetting factor accumulation of water recently passing through the valve. The length of the window is chosen to match the expected time from valve activation to the released water reaching and stabilising in the balance chamber.

As the drum speed increases the water supply pressure is reduced to increase the balance control resolution.

Early in the cycle (during acceleration) the magnitude of the balance correction vector is used to limit the acceleration rate. Typically there is always at least one balance valve open continuously and the drum accelerates as long as the largest corrected balance chamber vector remains below a predetermined threshold. The balance valve (or valves if neither end is in balance) that is on may vary as the weight distribution of the load changes as water is extracted.

Summary of Front Loading Embodiment

A front loading version of the washing machine may share substantially the same set of features and control system as the top loading embodiment described above. The balance system and control program described earlier are fully applicable to the front loading machine. The primary difference is the orientation of the drum so that one end faces the front of the cabinet. The drum is supported on a shaft extending from one end. The single shaft is supported in two or more bearings. Where the motor directly drives the shaft, the bearings may be provided either side of the motor or both may be provided between the motor and the drum. Suitable bearing arrangements are known for supporting the drum in the cantilever fashion. In these prior art machines the drum is supported from the rear wall of a suspended wash tub, where the wash tub may have up to 50 mm or more movement available. In a machine using the active balance system of the present invention the drum axis may be substantially rigidly supported, so the support structure may be a wash tub more strongly connected to a base platform or wrapper.

The balance correction system may have substantially the same structure with balance chambers provided at each end of the drum. The balance chambers may be supplied by catch rings in the same manner described above. However the catch rings are closer to the spin axis than the balance chambers. The inner diameter of the catch rings is therefor substantially smaller than the diameter of the drum. Providing catch rings and associated nozzles at the front end of the drum may limit the opening size of the drum door more than desirable. In that case catch rings and supply nozzles for both sets of balance chambers may be provided at the rear end, with supply channels or conduits extending to the front end balance chambers. The supply channels or conduits may extend, for example, from end to end inside vanes of the drum.

FIG. 16 illustrates schematically a front-loading washing machine. This schematic illustration of the front-loading washing machine is provided to illustrate an additional factor that can become significant in this type of machine. Typically, the front-loading washing machine includes a tub 1602 and a spin basket 1604. The spin basket is support in the tub by a shaft 1606. The shaft 1606 extends from one end 1608 of the spin basket 1604. End 1608 is a closed end and the shaft 1606 extends from the centre of this end. The shaft 1606 is rigidly fixed with end 1608 so that the entire spin basket 1604 is supported in a cantilever fashion from the shaft. The typical spin basket 1604 includes a perforated skin 1609. The perforated skin 1609 contains a laundry load but allows wash liquids to pass through, into of out of the spin basket 1604. The spin basket 1604 is open at end 1610. This opening 1610 is substantial in registration with an opening 1612 of the tub 1602. In use, these openings provide access to the interior of the spin basket 1604 for putting in a laundry load and taking out a laundry load. The surrounding cabinet of a washing appliance is not illustrated. Typically, the surrounding cabinet of the washing appliance would have a hatch or door providing access to opening 1612 of the tub. According to the present invention, the laundry machine includes an active balancing system, and in a preferred form of applying balancing corrections, the spin basket 1604 includes a set of balance chambers 1620 at each end. The balance chambers at each end are formed and supplied in a manner described earlier.

The whole structure of the spin basket 1604 is preferably sufficiently stiff to retain its shape at the high spin speeds contemplated for the laundry machine.

The shaft 1606 extends form the end 1608 of the spin basket 1604 to be supported in an end 1622 of the tub 1602. The end 1622 of the tub and the end 1608 of the spin basket 1604 are constructed with substantial reinforcing to reduce the amount the shaft mounting can rotate relative to the respective end wall. The supported end 1624 of the shaft 1606 is typically supported by a pair of spaced apart bearings 1626 located in bearing mounts of the end wall 1622. In a non-schematic embodiment, the shaft would extend beyond the wall 1622 and have a pulley, or a rotor of a direct drive motor, for applying rotation to the shaft.

According to the preferred form of the present invention, force and acceleration sensors are built into the mountings for each of the bearings 1626 to generate measurement signals from which physical behaviour of the system can be determined.

In the following explanation of the additional balancing factor contemplated by the present invention, reference is made to certain axes indicated on the drawing of FIG. 16, and to nomination of the balance ring locations at positions adjacent to each end 1 and 2 of the drums. The axes indicated are: x-axis extending in the direction of the rotation axis of the drum, in a positive direction from the closed end to the open end; the y-axis extending perpendicular to the x-axis, in the plane of the page, and being positive in an upward direction in the page, and the z-axis orthogonal to the y-axis and extending in a positive direction out of the page. The orientation of the orthogonal y-axis and z-axis is not critical but having one of these axis oriented in the vertical direction simplifies calculations by keeping gravitational forces in line with one axis. In the following calculations, a set of translation equations is provided to work with data originated for the forces and accelerations acting at location 1618 at the supporting point of the shaft 1606. These transformations directly manipulate this data for use in the balance calculation presented earlier including gyroscopic terms.

For the purpose of this calculation, the centre of mass 1616 of the rotating spin basket 1604 (and laundry load) is a distance $L_1$ from the centre line plane of balance chamber at the end 1 of the spin basket 1604 and the distance $L_2$ from the plane of the centre line of the chambers of end 2 of the spin basket 1604. Plane 1 is a distance $d_1$ from location 1618 of the shaft support and end plane 2 is a distance $d_2$ from location 1618. Angular orientation, and hence angular motion, of the complete assembly is accounted by angle $\theta_z$. In practice the angle $\theta_z$ will remain low, and in the following calculation, it is the angular acceleration of the entire assembly around the z-axis (and similarly around the y-axis) that is utilized rather than the physical angle.

In a front-loading machine illustrated schematically in FIG. 16, spin basket 1604 is supported as a cantilever on shaft 1606 from the end wall 1622 of tub 1602. Forces acting through the centre of mass 1616 include gravity and the centrifugal forces generated by any displacement of the centre of mass 1616 of the spin basket and laundry load away from the dead centre axis of the spin basket. These forces tend to bend the structure. This manifests the bending of the support shaft 1606, and also of the drum end 1608. This bending projects errors into the balance calculations which become significant where any inappropriate balance additions become critical.

A particular concern is that the balancing formulae provided earlier project the imbalance forces as components acting at each balance chamber plane by transformations that assume that the rotation axis of the drum remains linear and the ring of balance chambers remains centred on the rotation axis.

Referring yet again to FIG. 16, acceleration and forces can be measured at each of the supporting bearings 1626. This data is processed to provide forces, moments and accelerations applied to the shaft 1606 effective at location 1618.

The effective flexing of the structure including the shaft and spin basket end will be an effective change in angle of the shaft. This can be represented in the general form:

$$\Delta\theta = \frac{M}{k_s}$$

where $k_s$ is the effective stiffness of the shaft and drum end and may be a predetermined constant for the machine, stored in the controller. $\Delta\theta$ is the angle of shaft flex and M is the transverse moment.

This relationship is applied as an adjustment to accelerating terms of the balancing calculation.

For the front loading system of FIG. 16, the following equations transform $a_y$, $a_z$, $\alpha_y$, $\alpha_z$, $M_y$ and $M_Z$ to $a_{1y}$, $a_{1z}$, $a_{2y}$, $a_{2z}$, $f_{1suspy}$, $f_{2suspy}$ for use in the balancing equations presented earlier.

$$a_{1y} = a_y + d_1\left(\alpha_z + \omega^2 \frac{M_z}{k_s}\right)$$

$$a_{2y} = a_y + d_2\left(\alpha_z + \omega^2 \frac{M_z}{k_s}\right)$$

$$a_{1z} = a_z - d_1\left(\alpha_y + \omega^2 \frac{M_y}{k_s}\right)$$

$$a_{2z} = a_z - d_2\left(\alpha_y + \omega^2 \frac{M_y}{k_s}\right)$$

$M_Z$ and $M_y$ are moments applied to the shaft at measurement point. These may be calculated from the forces measured at the two bearings and the separation of the bearings. y represents the vertical position at the measuring point. $a_y$, $a_z$, $\alpha_y$ and $\alpha_z$ are the linear and angular accelerations at the effective support location 1618. These will typically be measured directly at a close by location and assumed to be representative of the accelerations at location 1618 or be derived from accelerations measured at each bearing 1626.

$$\begin{pmatrix} f_{1suspy} \\ f_{2suspy} \end{pmatrix} = \begin{bmatrix} 1 & 1 \\ d_1 & d_2 \end{bmatrix}^{-1} \begin{pmatrix} F_y \\ M_z \end{pmatrix}$$

The remaining values for adjustment are l, the location centre of mass and m, the mass of the rotating assembly. These may be calculated from the following equations.

$$m = \frac{\overline{f_y}}{g}$$

$$l_1 = \frac{\overline{M_z}}{\overline{f_y}} - d_1$$

These equations use the time average values of $f_y$ and $M_z$, not the complex magnitude and phase. In addition, $I_{rr}$ for the mass matrix [M] is calculated in the manner previously indicated using $I_{rr}=ml_{rr}^2$ where radius of gyration $l_{rr}$ is assumed constant. We also assume $$\frac{I_{xx}}{I_{rr}} = \left(\frac{l_{xx}}{l_{rr}}\right)^2 = \text{constant.}$$

These transformations account for the correction planes being displaced from the suspension location, so the relevant out of balance calculation provided earlier is that calculation described for application where the drum is suspended in line with the location of the correcting mass.

The invention claimed is:

1. A laundry machine comprising:

a drum for holding a laundry load, the drum supported at at least two spaced apart support locations for rotation about a rotation axis, sensors collectively providing:

output from which a force component of a supporting force on parallel axes at the two spaced apart support locations can be derived, output from which an acceleration component of acceleration of the two spaced apart support locations on the parallel axes can be derived, output from which angular velocity of said drum rotation axis can be derived, the derived angular velocity being about an axis perpendicular to the drum rotation axis, parallel to the axes of the force component and through the centre of mass of the drum and any held laundry load, wherein the sensor output from which the angular velocity is derived results from motion of the support locations perpendicular to the drum rotation axis, output from which a mass of the rotating drum and/or laundry load, and the axial location along the drum rotation axis of the centre of mass of the drum and/or laundry load, can be continuously derived, a balance correction system able to apply a variable amount of a balance correction mass at a selectable angular location of the drum at at least two spaced apart locations along the drum rotation axis, and a controller receiving outputs of the sensors, and programmed to continuously calculate balance corrections to apply, the calculation accounting for:

a) an effect of acceleration of the support locations on the derived force component, b) an effect conservation of angular momentum has on the force component sensor output due to the angular velocity of the drum rotation axis about the axis through the drum and/or laundry load's centre of mass, perpendicular to the drum rotation axis and parallel to the force component axes, and c) an effect the axial location of the centre of mass of the rotating drum and/or laundry load has on the effects in a) and b).

2. The laundry machine as claimed in claim 1, wherein the sensors comprise:

first sensors at the two spaced apart support locations, measuring forces such that the force component on parallel axes at the locations can be derived, second sensors at two spaced apart locations, providing output from which the acceleration component on the parallel axes at the locations of the second sensors can be derived, a third sensor or sensors, providing output from which the angular velocity of the drum rotation axis about the axis through the drum and any held laundry load's centre of mass, perpendicular to the drum rotation axis and parallel to the force component axes can be derived, a fourth sensor or sensors providing output from which the mass of the rotating drum and/or laundry load, and the axial location along the drum rotation axis of the centre of mass of the drum and/or laundry load, can be derived, the sensors not necessarily being individual relative to each other.

3. The laundry machine as claimed in claim 1, wherein the calculation estimates forces induced due to movement of the support locations in line with the force component axes.

4. The laundry machine as claimed in claim 1, wherein the calculation estimates forces induced due to movement of the support locations in a plane transverse to the force component axes.

5. The laundry machine as claimed in claim 4, wherein the calculation estimates forces induced due to movement of the support locations in a plane transverse to the force component axes as the product of a mass and inertia term and an acceleration term.

6. The laundry machine as claimed in claim 5, wherein the mass and inertia term accounts for the effect at each support location of movement applied at that support location and movement applied at the other support location based on reaction around the derived axial location along the drum rotation axis of the centre of mass of the drum and/or load.

7. The laundry machine as claimed in claim 5, wherein the acceleration term accounts for the movement on the force component axes and movement transverse to the force component axes.

8. The laundry machine as claimed in claim 7, wherein the acceleration term accounts for movement transverse to the force component axes by allocating a proportion of the total angular acceleration to each support location based on the derived axial location along the spin axis of the centre of mass of the drum and/or load between the support locations.

9. The laundry machine as claimed in claim 1, further including a support frame for the drum, and first and second bearings supporting the drum to rotate about a horizontal axis, wherein the bearings are rigidly, or substantially rigidly, supported in the support frame.

10. The laundry machine as claimed in claim 9, wherein the sensors include a first horizontal accelerometer sensing horizontal acceleration of the first bearing and a second horizontal accelerometer sensing horizontal acceleration of the second bearing.

11. The laundry machine as claimed in claim 1, further including balancing chambers distributed around each of two ends of the drum and water supply paths to transmit water to selected balancing chambers.

12. The laundry machine as claimed in claim 11, wherein the controller selectively supplies water to the balance chambers in each spin cycle, after calculating the required balance requirements, where the controller uses a physical model of the machine dynamics and calculates an absolute balance requirement accounting for accelerations that are being created or resisted in the vertical direction at each support location due to rotation or oscillation of the rotating drum in the horizontal plane.

13. The laundry machine as claimed in claim 12, wherein the controller estimates oscillation of the rotating drum in the horizontal plane from horizontal accelerations at the support locations.

14. The laundry machine as claimed in claim 13, wherein the controller converts the estimated oscillation to nominal vertical acceleration and applies this nominal acceleration effect as a correction to measured vertical acceleration.

15. The laundry machine as claimed in claim 14, wherein the controller uses corrected vertical accelerations to correct the derived components.

16. The laundry machine as claimed in claim 12, wherein the controller corrects derived components for the accelerations using a mass term that adjusts for the contribution of an acceleration applied at one support location to the derived force component at the other support location.

17. A laundry machine comprising:

a drum supported at at least two spaced apart support locations on a single support shaft for rotation about a rotation axis, sensors collectively providing:

output from which a force component of a supporting force on parallel axes at the two spaced apart support locations can be derived, output from which an acceleration component of acceleration of the two spaced apart support locations on the parallel axes can be derived, output from which angular velocity of said drum rotation axis can be derived, the derived angular velocity being about an axis perpendicular to the drum rotation axis, parallel to the axes of the force component and through the centre of mass of the drum and any held laundry load, wherein the sensor output from which the angular velocity is derived results from motion of the support locations perpendicular to the drum rotation axis, output from which a mass of the rotating drum and/or laundry load, and the axial location along the drum rotation axis of the centre of mass of the drum and/or laundry load, can be continuously derived, a balance correction system able to apply a variable amount of a balance correction mass at a selectable angular location of the drum at at least two spaced apart locations along the drum rotation axis, and a controller receiving outputs of the sensors, and programmed to continuously calculate balance corrections to apply, the calculation accounting for flexing of the single support shaft.

18. The laundry machine as claimed in claim 17, wherein the calculation estimates a force induced by additional centrifugal forces from angular displacement of the drum's principle axis away from the drum rotation axis due to shaft flexing.

19. The laundry machine as claimed in claim 17, wherein the calculation uses a stored value for stiffness of the support shaft and drum.

* * * * *